US008826562B2

(12) United States Patent
Kobayashi et al.

(10) Patent No.: US 8,826,562 B2
(45) Date of Patent: Sep. 9, 2014

(54) DRYING APPARATUS

(75) Inventors: Shinichirou Kobayashi, Osaka (JP); Tomonori Kikuno, Osaka (JP); Teruo Kido, Osaka (JP); Yasuhiro Utsumi, Osaka (JP); Takayuki Tanaka, Osaka (JP); Satoshi Tokuno, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 648 days.

(21) Appl. No.: 12/530,066

(22) PCT Filed: Feb. 27, 2008

(86) PCT No.: PCT/JP2008/000361

§ 371 (c)(1),
(2), (4) Date: Sep. 4, 2009

(87) PCT Pub. No.: WO2008/108066

PCT Pub. Date: Sep. 12, 2008

(65) Prior Publication Data

US 2010/0005682 A1 Jan. 14, 2010

(30) Foreign Application Priority Data

Mar. 8, 2007 (JP) ..... 2007-059167

(51) Int. Cl.

| | |
|---|---|
| ***F26B 3/347*** | (2006.01) |
| ***H05B 6/78*** | (2006.01) |
| ***F26B 15/10*** | (2006.01) |
| ***F26B 15/14*** | (2006.01) |
| ***F26B 25/00*** | (2006.01) |

(52) U.S. Cl.

CPC ..... *H05B 6/78* (2013.01); *H05B 2206/046* (2013.01); *F26B 15/10* (2013.01); *F26B 3/347* (2013.01); *F26B 15/14* (2013.01); *F26B 25/001* (2013.01)

USPC ..... 34/259; 219/753

(58) Field of Classification Search

CPC ..... F26B 15/10; F26B 15/14; F26B 23/10; F26B 3/347; H05B 6/78; H05B 2206/046

USPC ..... 34/259; 219/679, 752, 753

See application file for complete search history.

(56) References Cited

U.S. PATENT DOCUMENTS

| | | | | |
|---|---|---|---|---|
| 4,471,192 | A * | 9/1984 | Awata et al. | 34/259 |
| 5,334,403 | A * | 8/1994 | de Maillard | 426/241 |
| 5,467,694 | A | 11/1995 | Mochizuki et al. | |
| 2008/0023886 | A1 * | 1/2008 | Adrian et al. | 264/489 |

FOREIGN PATENT DOCUMENTS

| | | | |
|---|---|---|---|
| JP | 62-86685 | U | 6/1987 |
| JP | 3-75485 | A | 3/1991 |

(Continued)

*Primary Examiner* — Jiping Lu

(74) *Attorney, Agent, or Firm* — Birch, Stewart, Kolasch & Birch, LLP

(57) ABSTRACT

A former unit (20) as a drying apparatus includes a horizontally oriented main casing (21). Space inside the main casing (21) is divided into four irradiation zones (31-34). Each of the irradiation zones (31-34) contains one tray unit (10). Each of the tray units (10) contains four metallic transfer trays (14) aligned in the vertical direction, with a distance between the transfer trays (14) set to half a wavelength of a microwave (λ/2) or larger. Each of the transfer trays (14) carries wet PTFE powder. In the irradiation zones (31-34), the tray units (10) sequentially move from the first irradiation zone (31) to the fourth irradiation zone (34), and the microwave is laterally applied to the transfer trays (14).

10 Claims, 13 Drawing Sheets

(56) References Cited

FOREIGN PATENT DOCUMENTS

| | | | |
|---|---|---|---|
| JP | 6-104077 | A | 4/1994 |
| JP | 7-274922 | A | 10/1995 |
| JP | 8-28882 | A | 2/1996 |
| JP | 11-40339 | A | 2/1999 |
| JP | 11-83327 | A | 3/1999 |
| JP | 11-235720 | A | 8/1999 |
| JP | 2003-21460 | A | 1/2003 |

* cited by examiner (A) PLAN VIEW (B) FRONT VIEW (A) PLAN VIEW (B) FRONT VIEW (A) PLAN VIEW (B) FRONT VIEW

DRYING APPARATUS

TECHNICAL FIELD

The present invention relates to a drying apparatus for drying an object by applying a microwave to the object.

BACKGROUND ART

Drying apparatuses for evaporating moisture contained in a moisture-containing object by applying a microwave to the object have been known. For example, Patent Document 1 discloses a drying apparatus for drying an object, which is polytetrafluoroethylene (hereinafter referred to as "PTFE") powder, by applying a microwave to the PTFE powder in a wet state. In this drying apparatus, the wet PTFE powder is placed on a tray, and the microwave is applied to the PTFE powder on the tray from above. Patent Document 2 discloses a drying apparatus for drying an object, which is food fried in oil, by applying the microwave to the food. In this drying apparatus, the food as the object is transferred on a belt conveyor, and the microwave is applied from above to the horizontally moving food.

[Patent Document 1] Published Japanese Patent Application No. H11-235720

[Patent Document 2] Published Japanese Patent Application No. H07-274922

DISCLOSURE OF THE INVENTION

Problem that the Invention is to Solve

Another structure of the drying apparatus may be achieved by combining placing the object on the tray as described in Patent Document 1, and applying the microwave to the object on the tray from above while moving the tray in the horizontal direction as described in Patent Document 2. However, in moving a plurality of trays one by one in the horizontal direction, all the trays to which the microwave will be applied have to be aligned in the horizontal direction. This moving of the trays carrying the objects one by one in the horizontal direction may upsize the drying apparatus.

From this point of view, the present invention has been developed. The invention intends to downsize a drying apparatus for drying an object by using a microwave.

Means of Solving the Problem

In a first aspect of the invention, the invention is directed to a drying apparatus for drying a moisture-containing object by applying a microwave to the object. The drying apparatus includes: a metallic transfer tray (14) for carrying the moisture-containing object; and a main body (20) for containing multiple ones of the transfer tray (14) vertically aligned at predetermined intervals, and laterally applying the microwave to the contained transfer trays (14), wherein a distance between the vertically adjacent transfer trays (14) in the main body (20) is set to $\lambda/2$, where $\lambda$ is a wavelength of the microwave applied to the transfer trays (14).

According to the first aspect of the invention, a wet object is placed on the transfer tray (14), and the transfer tray (14) carrying the object is contained in the main body (20). The transfer tray (14) is made of metal, such as stainless steel. In the main body (20), multiple ones of the transfer tray (14) are vertically aligned at predetermined intervals, and a microwave (an electromagnetic wave of a frequency of 300 MHz to 30 GHz, both inclusive) is applied to the vertically aligned transfer trays (14). A distance between the vertically aligned transfer trays (14) in the main body (20) is set to half a wavelength $\lambda$ of the microwave applied to the transfer trays (14) or larger (i.e., $\lambda/2$ or larger). Moisture contained in the objects on the transfer trays (14) generates heat to evaporate as it absorbs the microwave, and is released in the atmosphere.

In a second aspect of the invention related to the first aspect of the invention, the main body (20) includes a metallic casing member (21) for forming space for containing the vertically aligned transfer trays (14), and a distance between a side portion of each of the transfer trays (14) and a portion of the casing member (21) facing the side portion of each of the transfer trays (14) is set to $\lambda$ or larger.

According to the second aspect of the invention, a plurality of vertically aligned transfer trays (14) are contained in the metallic casing member (21) of the main body (20). Specifically, the metallic transfer trays (14) are contained in the metallic casing member (21). In the main body (20), a lateral distance between the casing member (21) and the transfer trays (14) is set to the wavelength $\lambda$ of the microwave applied to the transfer trays (14) or larger. The microwave laterally applied to the transfer trays (14) contained in the casing member (21) is reflected on the casing member (21) and the transfer trays (14), and arrives at the objects on the transfer trays (14).

In a third aspect of the invention related to the first or second aspect of the invention, the main body (20) is configured to apply the microwave to the transfer trays (14) in multiple directions.

According to the third aspect of the invention, the microwave is applied to the transfer trays (14) contained in the main body (20) in multiple directions. The microwave applied in the multiple directions is gradually absorbed by the moisture in the objects on the transfer trays (14).

In a fourth aspect of the invention related to the third aspect of the invention, the main body (20) includes a transfer mechanism (25) for transferring the vertically aligned transfer trays (14), and a direction of microwave application to the transfer trays (14) varies as the transfer trays (14) move.

According to the fourth aspect of the invention, the main body (20) includes the transfer mechanism (25), and the plurality of vertically aligned transfer trays (14) are transferred by the transfer mechanism (25). In the main body (20), the microwave is applied to the transfer trays (14) being transferred by the transfer mechanism (25), and the direction of microwave application varies as the transfer trays (14) move.

In a fifth aspect of the invention related to the third aspect of the invention, the main body (20) includes a transfer mechanism (25) for transferring the vertically aligned transfer trays (14), and a plurality of microwave irradiators (40, 45, . . . ) each applying the microwave to the transfer trays (14), and the plurality of microwave irradiators (40, 45, . . . ) are arranged in the direction of movement of the transfer trays (14), with their directions of microwave application to the transfer trays (14) different from each other.

According to the fifth aspect of the invention, the main body (20) includes the transfer mechanism (25), and the plurality of vertical aligned transfer trays (14) are transferred by the transfer mechanism (25). In the main body (20), the plurality of microwave irradiators (40, 45, . . . ) are arranged in the direction of movement of the transfer trays (14). The directions of microwave application by the microwave irradiators (40, 45, . . . ) are different from each other. Therefore, the direction of microwave application to the transfer trays (14) in the main body (20) varies as the transfer trays (14) move.

In a sixth aspect of the invention related to the fifth aspect of the invention, each of the transfer trays (14) is rectangular-shaped, and the microwave irradiators (40, 45, . . . ) are arranged in one-to-one correspondence with sides of the transfer trays (14).

According to the sixth aspect of the invention, the main body (20) includes four microwave irradiators (40, 45, . . . ). The microwave irradiators (40, 45, . . . ) are arranged in one-to-one correspondence with the sides of the rectangular-shaped transfer trays (14), respectively. Each of the microwave irradiators (40, 45, . . . ) applies the microwave to side portions of the transfer trays (14). The positions of the microwave irradiators (40, 45, . . . ) are shifted from each other in the direction of movement of the transfer trays (14). Therefore, the direction of microwave application to the transfer trays (14) varies as the transfer trays (14) move.

In a seventh aspect of the invention related to the fourth, fifth or sixth aspect of the invention, a tray unit (10) including the multiple transfer trays (14) vertically aligned at intervals of $\lambda/2$ or larger is formed in the main body (20), and the transfer mechanism (25) is configured to horizontally move the tray unit (10).

In an eighth aspect of the invention related to the sixth aspect of the invention, a tray unit (10) including the multiple transfer trays (14) vertically aligned at intervals of $\lambda/2$ or larger is formed in the main body (20), and the transfer mechanism (25) horizontally moves the tray unit (10), and each of the microwave irradiators (40, 45, . . . ) includes irradiation ports (43, 48, . . . ) provided laterally next to the transfer trays (14) in the tray unit (10) in one-to-one correspondence, and is configured to apply the microwave to the transfer trays (14) through the irradiation ports (43, 48, . . . ).

According to the seventh and eighth aspects of the invention, the tray unit (10) including a plurality of transfer trays (14) is formed. In the tray unit (10), the plurality of transfer trays (14) are vertically aligned, and a distance between the transfer trays (14) is set to $\lambda/2$ or larger. The transfer mechanism (25) horizontally moves the tray unit (10) in the main body (20). Specifically, the plurality of transfer trays (14) vertically aligned at predetermined intervals in the tray unit (10) move in the horizontal direction in the main body (20). In the main body (20), the direction of microwave application to the transfer trays (14) in the tray unit (10) varies as the tray unit (10) moves in the horizontal direction.

Still according to the eighth aspect of the invention, each of the microwave irradiators (40, 45, . . . ) includes the same number of irradiations ports (43, 48, . . . ) as the transfer trays (14) in the single tray unit (10). The irradiation ports (43, 48, . . . ) of each of the microwave irradiators (40, 45, . . . ) are arranged in one-to-one correspondence with the transfer trays (14) in the single tray unit (10). Each of the irradiation ports (43, 48, . . . ) is provided laterally next to the corresponding transfer tray (14). The microwave is laterally applied to the corresponding transfer trays (14) through the irradiation ports (43, 48, . . . ), respectively.

In a ninth aspect of the invention related to any one of the first to eighth aspects of the invention, the object to be dried is resin powder.

According to the ninth aspect of the invention, wet resin powder is placed on the transfer tray (14) as an object. The microwave applied to the transfer tray (14) is absorbed by moisture contained in the resin powder on the transfer tray (14), and the moisture is heated to evaporate.

Examples of the resin powder include general-purpose resin powders, so-called engineering plastic powders, etc. Specific examples thereof include powders of polyethylene, polyvinyl chloride, polypropylene, polystyrene, polyvinyl acetate, ABS resin (acrylonitrile-butadiene-styrene resin), AS resin (acrylonitrile-styrene resin), metacrylate resin, polyacetal, polyamide, polyimide, polyamide-imide, polycarbonate, polyphenylene ether, polybutylene terephthalate, polyarylate, polysulfone, polyether sulfone, polyether imide, polyphenylene sulfide, polyether ether ketone, fluorine-containing resin, etc.

Examples of the fluorine-containing resin powders include powders of polytetrafluoroethylene (PTFE), tetrafluoroethylene/hexafluoropropylene copolymer (FEP), tetrafluoroethylene/perfluoroalkyl vinyl ether copolymer (PFA), polychlorotrifluoroethylene (PCTFE), polyvinylidene fluoride (PVDF), ethylene/tetrafluoroethylene copolymer (ETFE), ethylene/chlorotrifluoroethylene copolymer (ECTFE), etc.

Effect of the Invention

According to the present invention, the transfer trays (14) each carrying an object are aligned in the vertical direction. As compared with an apparatus in which all the transfer trays (14) to be treated are aligned in the horizontal direction, the drying apparatus of the present invention can reduce a floor area required to contain the transfer trays (14) by the number of vertically stacked transfer trays (14). For example, when five transfer trays (14) are vertically stacked, the floor area required to contain the transfer trays (14) is reduced to ⅕ as compared with the case where the transfer trays (14) are aligned in the horizontal direction. Moreover, if all the transfer trays (14) to be treated are vertically aligned, the floor area required to contain the transfer trays (14) will be an area of a single transfer tray (14). Thus, the present invention makes it possible to drastically reduce the floor area occupied by the main body (20) for containing the transfer trays (14), thereby downsizing the drying apparatus.

An electromagnetic wave, such as the microwave, is inherently impossible to pass through "a gap between metallic objects sufficiently smaller than the wavelength of the electromagnetic wave", such as interstices of a metal mesh. Therefore, if the distance between the vertically aligned metallic transfer trays (14) is small, the microwave is less likely to enter the gap between the adjacent transfer trays (14), resulting in insufficient heating of the objects on the transfer trays (14) by the microwave.

In contrast, according to the present invention, the transfer trays (14) each carrying the object are vertically aligned at intervals of $\lambda/2$ or larger, and the microwave is laterally applied to the vertically aligned transfer trays (14). Specifically, the present invention provides a sufficient distance between the vertically aligned metallic transfer trays (14). Therefore, the microwave laterally applied to the vertically aligned transfer trays (14) is not disturbed by the metallic transfer trays (14), but arrives at the object on each of the transfer trays (14). Thus, the present invention makes it possible to reliably heat the moisture contained in the object on each of the transfer trays (14), thereby reliably reducing the moisture contents in the objects on the transfer trays (14).

According to the second aspect of the invention, the metallic transfer trays (14) are contained in the metallic casing member (21), and the microwave is laterally applied to the transfer trays (14). Further, a lateral distance between the casing member (21) and the transfer trays (14) is set to the wavelength $\lambda$ of the applied microwave or larger. Specifically, the present invention provides a sufficient distance between the casing member (21) and the transfer trays (14) in the direction of microwave application. Therefore, the microwave laterally applied to the transfer trays (14) can be dispersed and distributed to the transfer trays (14). Thus, the present invention makes it possible to evenly heat the moisture in each of the objects on the transfer trays (14), thereby averaging the moisture contents in the objects on the transfer trays (14).

According to the third aspect of the invention, the microwave is applied to the transfer trays (14) contained in the main body (20) in multiple directions. In the main body (20), the applied microwave is gradually absorbed by the moisture in the object. Therefore, the energy of the microwave is attenuated as the microwave travels away from an outlet of the microwave in the main casing (20). However, since the microwave is applied to the transfer trays (14) in the multiple directions, the present invention makes it possible to evenly heat the moisture in each of the objects on the transfer trays (14), thereby averaging the moisture contents in the objects on the transfer trays (14).

According to the sixth aspect of the invention, the microwave is applied to the four side portions of each of the rectangular-shaped transfer trays (14). Therefore, the energy of the microwave applied to the object on the transfer tray (14) is reliably averaged on every part of the transfer tray (14). Thus, the invention makes it possible to evenly heat the moisture in each of the objects on the transfer trays (14), thereby reliably averaging the moisture contents in the objects on the transfer trays (14).

According to the seventh and eighth aspects of the invention, a tray unit (10) including a plurality of transfer trays (14) vertically aligned at intervals of $\lambda/2$ or larger is formed, and the tray unit (10) is transferred by the transfer mechanism (25). Therefore, the plurality of transfer trays (14) can easily be moved while keeping the distance between the transfer trays (14). This can simplify the structure of the transfer mechanism (25) as compared with the case where the plurality of vertically aligned transfer trays (14) are transferred one by one.

In particular, according to the eighth aspect of the invention, the irradiation ports (43, 48, . . . ) are provided in one-to-one correspondence with the transfer trays (14) in the single tray unit (10). This can average the energy of the microwave applied to the objects on the transfer trays (14), thereby equalizing the moisture contents in the objects on the transfer trays (14).

DESCRIPTION OF CHARACTERS

Figure 1:
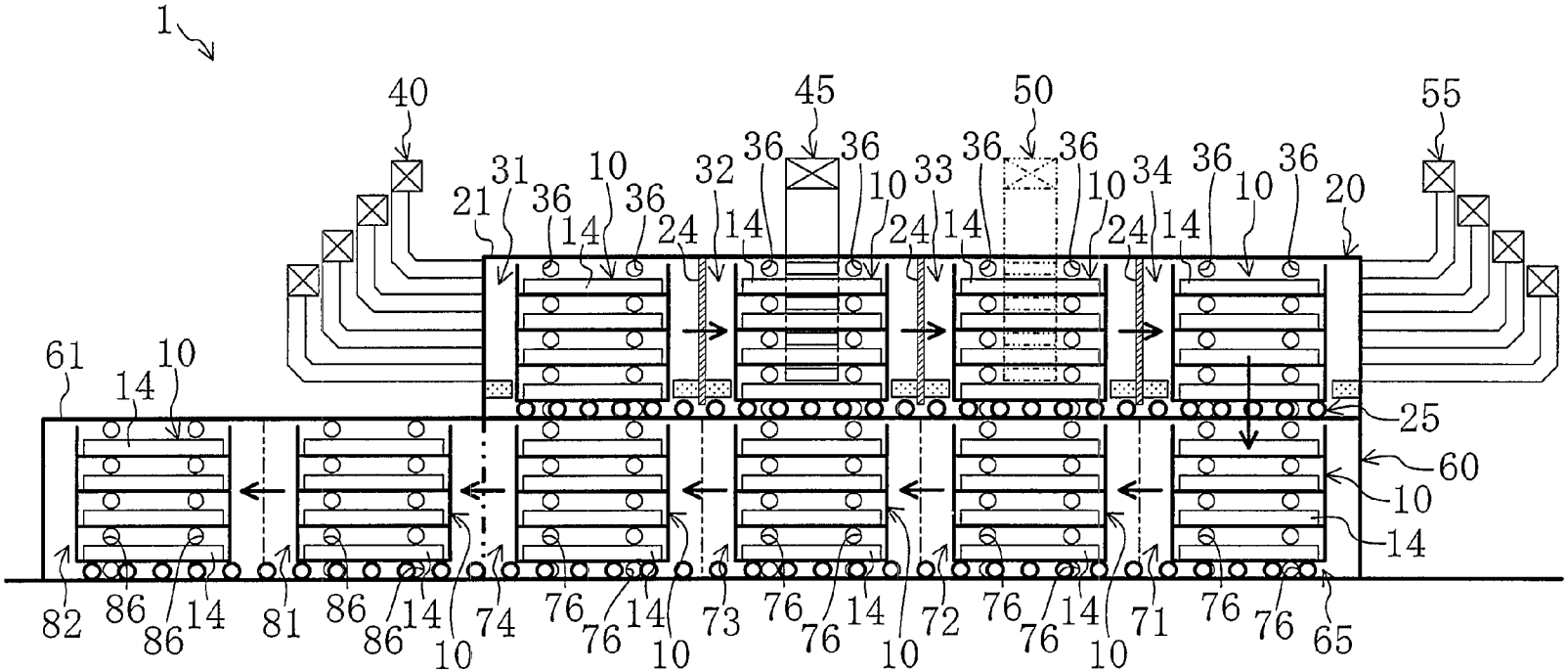
FIG. 1 is a front view illustrating a production apparatus of a first embodiment, partially omitted.

10 Tray unit
14 Transfer tray
20 Former unit (main body)
21 Main casing (casing member)
25 Roller conveyor (transfer mechanism)
40 First microwave irradiator
43 Irradiation port
45 Second microwave irradiator
48 Irradiation port
50 Third microwave irradiator
53 Irradiation port
55 Fourth microwave irradiator
58 Irradiation port

BEST MODE FOR CARRYING OUT THE INVENTION

Hereinafter, embodiments of the present invention will be described in detail with reference to the drawings.

First Embodiment

A first embodiment of the present invention will be described. A production apparatus (1) of the present embodiment is an apparatus used in the course of producing PTFE (polytetrafluoroethylene) powder, to obtain dry PTFE powder as a final product by treating wet PTFE powder. In the following description, "right," "left," "front," "rear," "frontward," and "rearward" are directions relative to the production apparatus (1) viewed from the front.

The PTFE powder is produced by polymerization in water. Therefore, obtaining dry PTFE powder requires drying the wet PTFE powder produced by the polymerization. In some cases, the PTFE powder is used as a material for extruding an article made of PTFE. The PTFE powder for this application is required to exhibit nearly constant extrusion pressure when it is extruded. To meet this requirement, a thermal treatment of the PTFE powder is required. Therefore, the production apparatus (1) of the present embodiment performs drying the wet PTFE powder, and thermally treating the dried PTFE powder.

As shown in FIG. 1, the production apparatus (1) of the present embodiment includes a former unit (20) and a latter unit (60). The former unit (20) is a unit for applying a microwave to the PTFE powder, and constitutes a drying apparatus of the present invention together with a transfer tray (14)

described later. The latter unit (60) is a unit for heating the PTFE powder that passed through the former unit (20) with high temperature air. In this production apparatus (1), the former unit (20) is placed on the latter unit (60).

Figure 2:
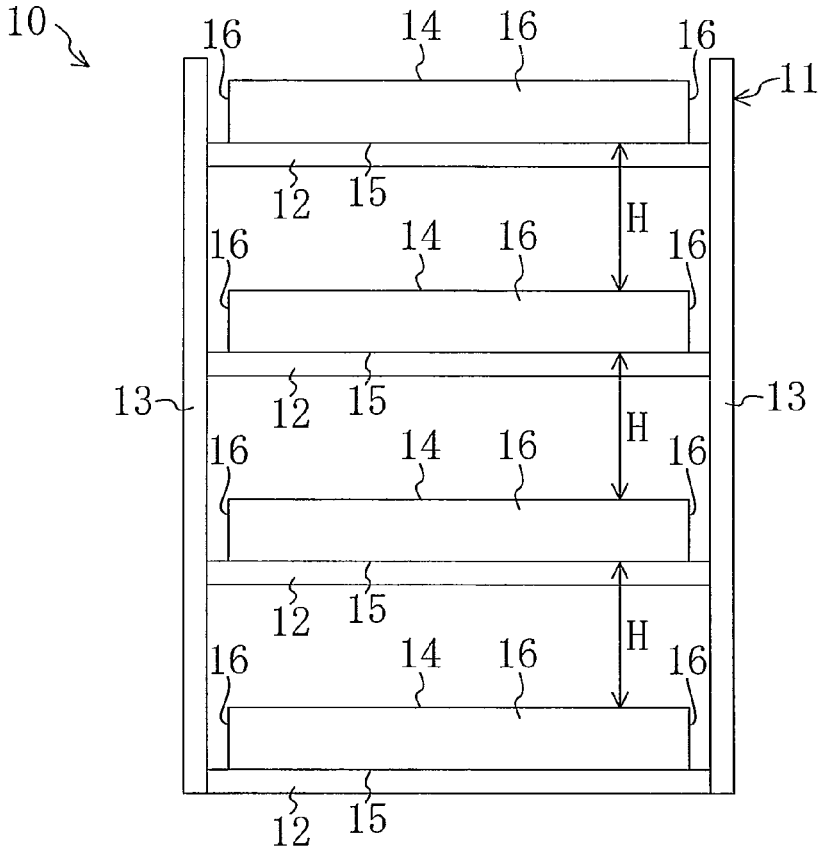
FIG. 2 is a front view illustrating a schematic structure of a tray unit.

The production apparatus (1) of the present embodiment includes a plurality of tray units (10) as shown in FIG. 2. Each of the tray units (10) includes four transfer trays (14) and one tray rack (11).

Figure 3:
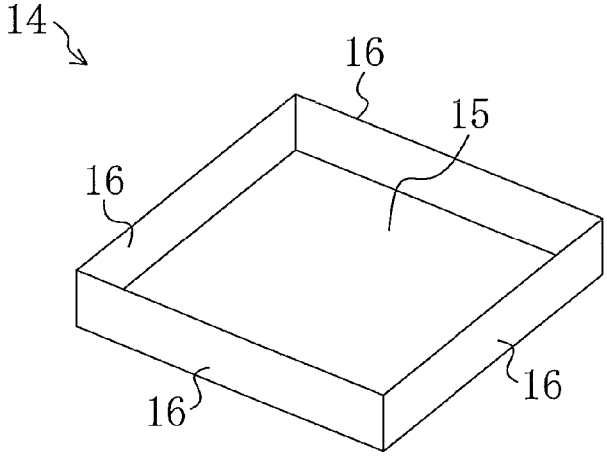
FIG. 3 is a perspective view illustrating a schematic structure of a transfer tray.

As shown in FIG. 3, the transfer tray (14) is a flat, rectangular parallelepiped-shaped container having an opening at the top thereof. Specifically, the transfer tray (14) includes a bottom plate (15) and side plates (16), both of which are made of stainless steel. The bottom plate (15) is a substantially square-shaped flat plate. Although not shown, the bottom plate (15) has a plurality of drainage holes of about 0.5 mm diameter arranged at a pitch of about 1.0 mm. The side plate (16) is a flat, oblong rectangular plate. The side plate (16) is provided on each of the sides of the bottom plate (15) to be substantially orthogonal to the bottom plate (15). Each of the transfer trays (14) carries wet PTFE powder.

As shown in FIG. 2, the tray rack (11) includes four frame members (12) and four column members (13), both of which are made of stainless steel. The frame members (12) are rectangular-shaped, and are vertically aligned at predetermined intervals. The column members (13) are rod-shaped, and are arranged at corners of the vertically aligned frame members (12), respectively. In this tray rack (11), one transfer tray (14) is placed on each of the frame members (12). A distance between the frame members (12) of the tray rack (11) is set in such a manner that a distance between the transfer trays (14) placed on the frame members (12) is set to a certain value H. That is, a pair of transfer trays (14) vertically adjacent to each other in the tray rack (11) has a distance of the certain value H between a bottom surface of the bottom plate (15) of the upper transfer tray (14) and upper end surfaces of the side plates (16) of the lower transfer tray (14).

Figure 4:
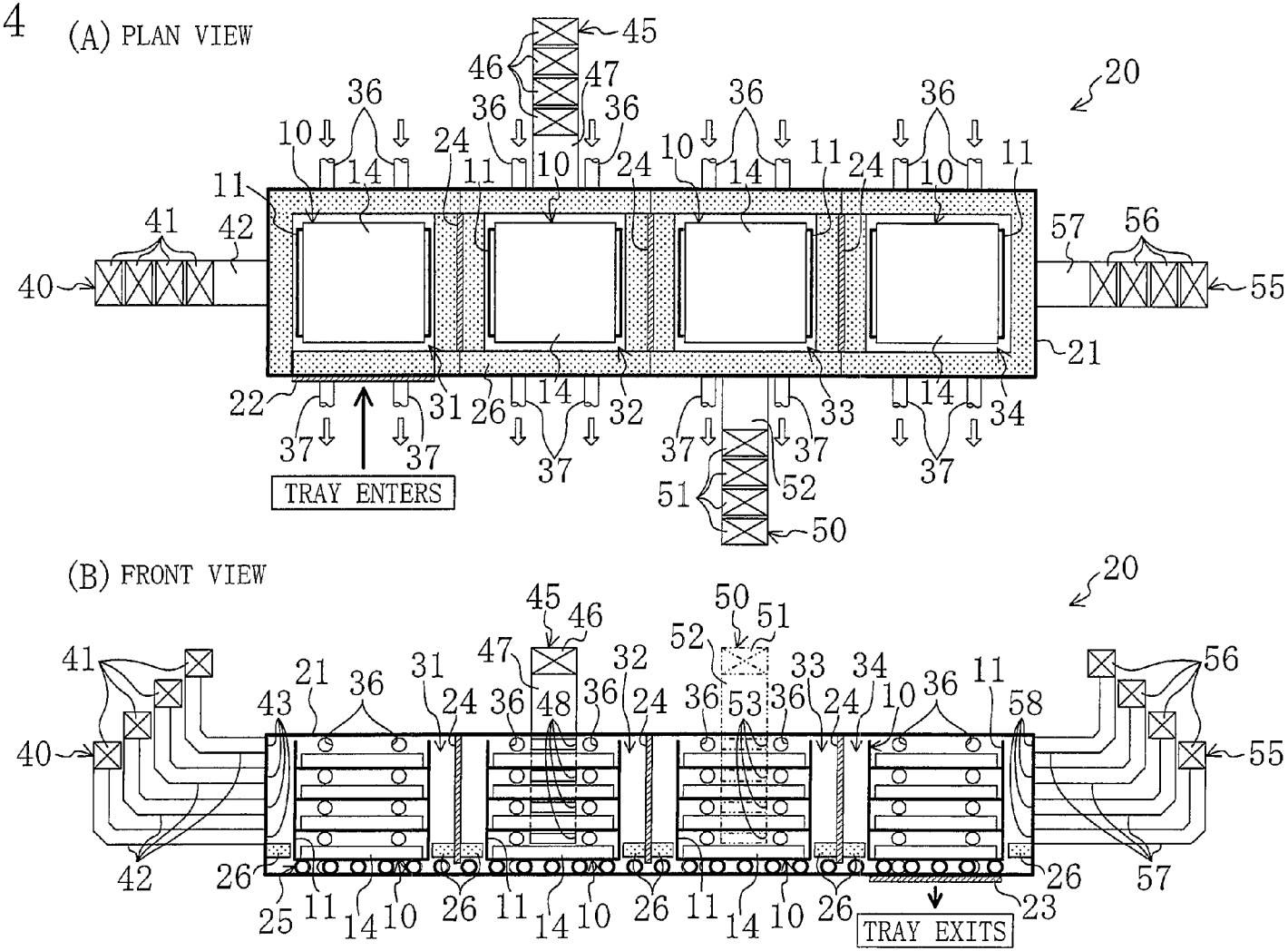
FIGS. 4(A) and 4(B) are a plan view and a front view illustrating a former unit of the first embodiment, partially omitted.

As shown in FIG. 4, the former unit (20) includes a main casing (21) as a casing member, and a roller conveyor (25) as a transfer mechanism. The former unit (20) further includes four microwave irradiators (40, 45, 50, 55). The former unit (20) constitutes a main body of the drying apparatus of the present invention.

The main casing (21) is in the shape of a duct having a rectangular cross section and closed ends, and is placed with the longitudinal direction thereof substantially matching with the horizontal direction. Space inside the main casing (21) is used to contain the tray racks (11). Three partition doors (24) are arranged at regular intervals in the longitudinal direction in the space inside the main casing (21). The partition doors (24) will be described later.

The space inside the main casing (21) is divided into four rooms by the three partition doors (24). Among the four rooms divided by the partition doors (24) in the main casing (21), the leftmost room is a first irradiation zone (31), the room on the right of the first irradiation zone is a second irradiation zone (32), the room on the right of the second irradiation zone is a third irradiation zone (33), and the rightmost room is a fourth irradiation zone (34). Each of the irradiation zones (31-34) is as large as it can contain one tray unit (10).

Each of the partition doors (24) is a flat, rectangular stainless steel plate corresponding to the cross sectional shape of the main casing (21). The partition door (24) is opened/closed as it moves in the vertical direction. When the partition door (24) is opened, the irradiation zones (31-34) adjacent to each other with the partition door interposed therebetween communicate with each other.

The main casing (21) is provided with an inlet door (22) and an outlet door (23). The inlet door (22) is arranged on a front surface of the main casing (21) to face the first irradiation zone (31). The inlet door (22) is a flat, rectangular stainless steel plate, and is opened/closed as it moves in the vertical direction. When the inlet door (22) is opened, the first irradiation zone (31) communicates with the outside of the main casing (21). The outlet door (23) is arranged on a bottom surface of the main casing (21) to face the fourth irradiation zone (34). The outlet door (23) is a flat, rectangular stainless steel plate, and is opened/closed as it moves in the horizontal direction. When the outlet door (23) is opened, the fourth irradiation zone (34) communicates with the outside of the main casing (21).

A roller conveyer (25) is contained in the space inside the main casing (21). The roller conveyor (25) is placed on the bottom of the main casing (21), and extends in the longitudinal direction of the main casing (21) to cover almost the entire length of the main casing (21). The tray units (10) contained in the main casing (21) are placed on the roller conveyor (25), and are transferred from the left to the right by the roller conveyor (25).

To the main casing (21), are connected air intake ducts (36) for supplying air into the irradiation zones (31-34), and air exhaust ducts (37) for discharging the air from the irradiation zones (31-34). In the main casing (21), 10 air intake ducts (36) and 10 air exhaust ducts (37) are connected to each of the four irradiation zones (31-34).

The air intake ducts (36) are connected to a rearward side surface (i.e., a rear surface) of the main casing (21), and are opened in the corresponding irradiation zones (31-34). In each of the tray units (10) contained in the irradiation zones (31-34), three pairs of air intake ducts (36) are positioned between the adjacent transfer trays (14), respectively, a pair of air intake ducts (36) are positioned above the uppermost transfer tray (14), and a pair of air intake ducts (36) are positioned below the lowermost transfer tray (14).

The air exhaust ducts (37) are connected to a frontward side surface (i.e., a front surface) of the main casing (21), and are opened in the corresponding irradiation zones (31-34). In each of the tray units (10) contained in the irradiation zones (31-34), three pairs of air exhaust ducts (37) are positioned between the adjacent transfer trays (14), respectively, a pair of air exhaust ducts (37) are positioned above the uppermost transfer tray (14), and a pair of air exhaust ducts (37) are positioned below the lowermost transfer tray (14).

Each of the microwave irradiators (40, 45, 50, 55) includes microwave oscillators (41, 46, 51, 56) and waveguides (42, 47, 52, 57) of the same number as the number of the transfer trays (14) contained in one tray unit (10). In the present embodiment, four transfer trays (14) are contained in the single tray unit (10). Therefore, each of the microwave irradiators (40, 45, 50, 55) of the present embodiment includes four microwave oscillators (41, 46, 51, 56) and four waveguides (42, 47, 52, 57).

The microwave oscillators (41, 46, 51, 56) are configured to generate a microwave of a frequency of 2.45 GHz at an output of about 1.0 kW. Each of the waveguides (42, 47, 52, 57) guides the microwave generated by the microwave oscillators (41, 46, 51, 56) to the irradiation zones (31-34), and is made of a metallic tube having a horizontally oriented rectangular cross section. Each of the waveguides (42, 47, 52, 57) is generally L-shaped. The microwave oscillators (41, 46, 51, 56) are connected to starting ends of the waveguides (42, 47, 52, 57) in one-to-one correspondence.

Terminal ends of the waveguides (42, 47, 52, 57) are attached to the side surfaces of the main casing (21), and penetrate the main casing (21) to open in the corresponding irradiation zones (31-34). The waveguides (42) of the first microwave irradiator (40) are attached to a left end surface of the main casing (21), and the terminal ends thereof serve as irradiation ports (43) opened in the first irradiation zone (31). The waveguides (47) of the second microwave irradiator (45) are attached to a rearward side surface (i.e., a rear surface) of the main casing (21) to face the second irradiation zone (32), and the terminal ends thereof serve as irradiation ports (48) opened in the second irradiation zone (32). The waveguides (52) of the third microwave irradiator (50) are attached to a frontward side surface (i.e., a front surface) of the main casing (21) to face the third irradiation zone (33), and the terminal ends thereof serve as irradiation ports (53) opened in the third irradiation zone (33). The waveguides (57) of the fourth microwave irradiator (55) are attached to a right end surface of the main casing (21), and the terminal ends thereof serve as irradiation ports (58) opened in the fourth irradiation zone (34).

The terminal ends of the four waveguides (42, 47, 52, 57) of each of the microwave irradiators (40, 45, 50, 55) are aligned in the vertical direction at regular intervals. That is, the four irradiation ports (43, 48, 53, 58) are aligned in the vertical direction in each of the irradiation zones (31-34) formed in the main casing (21). The irradiation ports (43) are opened in the fore-and-aft center of the first irradiation zone (31). The irradiation ports (48) are opened in the lateral center of the second irradiation zone (32). The irradiation ports (53) are opened in the lateral center of the third irradiation zone (33). The irradiation ports (58) are opened in the fore-and-aft center of the fourth irradiation zone (34). In each of the tray units (10) contained in the irradiation zones (31-34), three of the irradiation ports (43, 48, 53, 58) are positioned between the adjacent transfer trays (14), respectively, and the remaining one of them is positioned above the uppermost transfer tray (14).

A shielding frame (26) is arranged in each of the irradiation zones (31-34) of the main casing (21). The shielding frame (26) is arranged along an inner wall surface of the main casing (21) and the partition doors (24), and surrounds the lowermost transfer tray (14) of the tray unit (10) contained in each of the irradiation zones (31-34). Part of the shielding frame (26) in contact with the partition door (24) moves in the vertical direction together with the partition door (24). The shielding frame (26) has an oblong rectangular cross section, and has an inner circumferential surface facing the side plates (16) of the lowermost transfer tray (14) in the tray unit (10). The height of the shielding frame (26) is equal to or slightly larger than the height of the transfer tray (14). The shielding frame (26) is made of metal.

Figure 5:
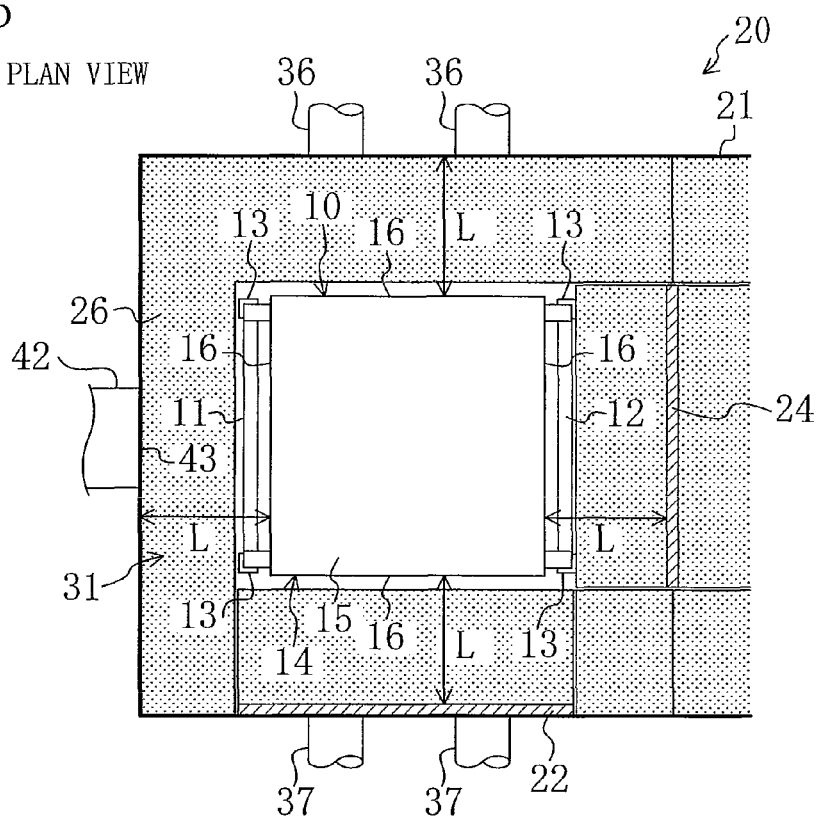
FIGS. 5(A) and 5(B) are a plan view and a front view, both of which illustrating an enlargement of a major part of the former unit of the first embodiment, partially omitted.
Figure 5:
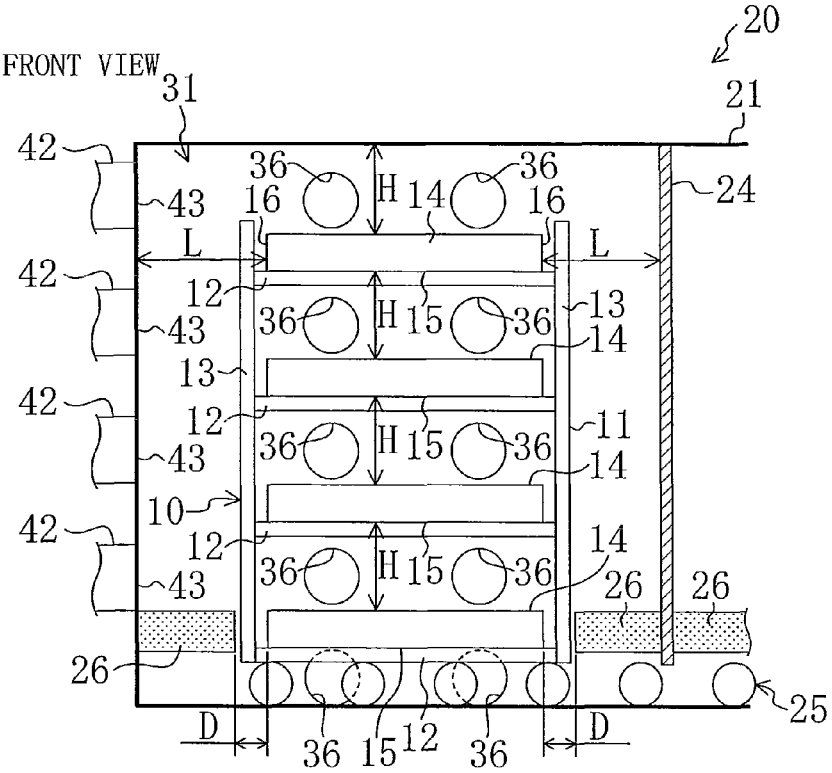

As shown in FIG. 5, with the tray units (10) contained in the irradiation zones (31-34), respectively, a distance of a predetermined value is provided between walls defining the irradiation zones (31-34) and the transfer tray (14). FIG. 5 shows the tray unit (10) contained in the first irradiation zone (31).

Specifically, a distance between the upper end surfaces of the side plates (16) of the uppermost transfer tray (14) in the tray unit (10) and a ceiling surface of the main casing (21) is set to the value H, which is the same as the distance between the transfer trays (14). A distance between the side surfaces of the first to third uppermost transfer trays (14) in the tray unit (10) and the inner wall surface of the main casing (21) is set to a value L in both the lateral and fore-and-aft directions. A distance between the side surfaces of the lowermost transfer tray (14) in the tray unit (10) and the inner circumferential surface of the shielding frame (26) is set to a constant value D along the entire circumference of the transfer tray (14). The distance D between the transfer tray (14) and the shielding frame (26) is set to a value that does not allow the microwave applied to the transfer tray (14) to pass through a gap between them.

Provided that the frequency of the microwave generated by the microwave oscillators (41, 46, 51, 56) of the microwave irradiators (40, 45, 50, 55) is $\lambda$, the distance H is set to a value equal to or larger than $\lambda/2$ ($H \geq \lambda/2$), and the distance L is set to a value equal to or larger than $\lambda$ ($L \leq \lambda$) in the irradiation zones (31-34) of the present embodiment. The microwave generated by the microwave oscillators (41, 46, 51, 56) of the present embodiment has a frequency of 2.45 GHz, and a wavelength of 128 mm. Therefore, the distance H is set to 64 mm or larger, and the distance L is set to 128 mm or larger in the irradiation zones (31-34) of the present embodiment.

Figure 6:
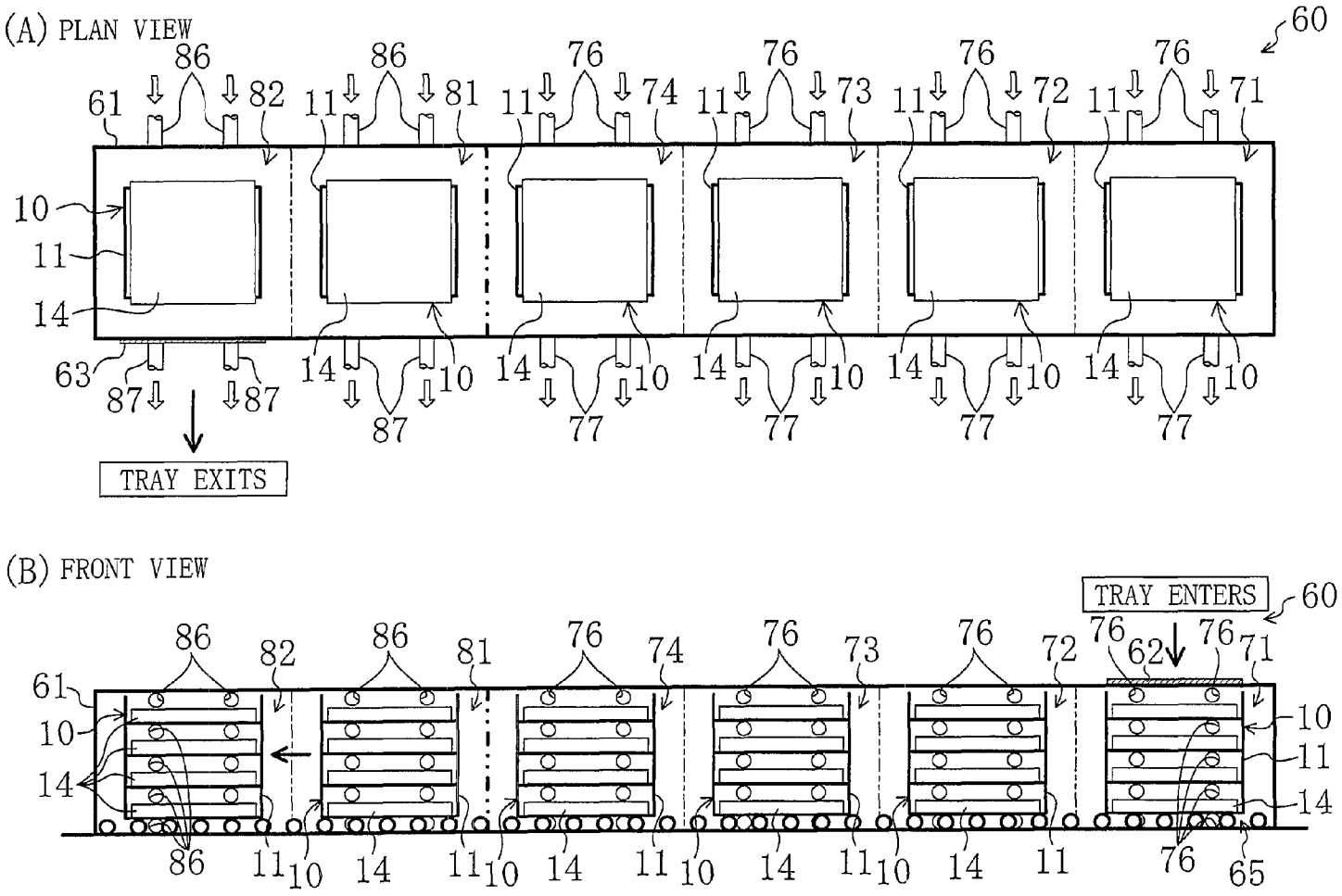
FIGS. 6(A) and 6(B) are a plan view and a front view, both of which illustrating a latter unit of the first embodiment, partially omitted.

As shown in FIG. 6, the latter unit (60) includes a main casing (61) and a roller conveyor (65).

The main casing (61) is in the shape of a duct having a rectangular cross section and closed ends, and is placed with the longitudinal direction substantially matching with the horizontal direction. Space inside the main casing (61) is used to contain the tray racks (11). The main casing (61) of the latter unit (60) is about 1.5 times as long as the main casing (21) of the former unit (20). The main casing (61) of the latter unit (60) contains six tray units (10) aligned in the longitudinal direction.

The space inside the main casing (61) is divided into six zones (71-74, 81, 82) in the longitudinal direction, and the tray units (10) are contained in the zones (71-74, 81, 82), respectively. However, the zones (71-74, 81, 82) are virtually defined, i.e., the space inside the main casing (61) is not physically divided by partitions, etc.

Four zones from the right end of the main casing (61) serve as drying zones (71-74), and the remaining two zones serve as thermal treatment zones (81, 82). The main casing (61) includes a first drying zone (71), a second drying zone (72), a third drying zone (73), and a fourth drying zone (74) sequentially aligned from the right to the left. In the main casing (61), a zone on the left of the fourth drying zone (74) is a first thermal treatment zone (81), and the leftmost zone is a second thermal treatment zone (82).

The main casing (61) is provided with an inlet door (62) and an outlet door (63). The inlet door (62) is arranged on a top surface of the main casing (61) to face the first drying zone (71). The inlet door (62) is a flat rectangular stainless steel plate, and is opened/closed as it moves in the horizontal direction. When the inlet door (62) is opened, the first drying zone (71) communicates with the outside of the main casing (61). The outlet door (63) is arranged on a front surface of the main casing (61) to face the second thermal treatment zone (82). The outlet door (63) is a flat, rectangular stainless steel plate, and is opened/closed as it moves in the vertical direction. When the outlet door (63) is opened, the second thermal treatment zone (82) communicates with the outside of the main casing (61).

As described above, the former unit (20) is placed on the latter unit (60). With the former unit (20) placed on the latter unit (60), the outlet door (23) on the bottom surface of the main casing (21) of the former unit (20) faces the inlet door (62) on the top surface of the main casing (61) of the latter unit (60). In the present embodiment, a single door may be used as both the outlet door (23) of the former unit (20) and the inlet door (62) of the latter unit (60).

The roller conveyor (65) is contained in the space inside the main casing (61). The roller conveyor (65) is placed on the bottom of the main casing (61), and extends in the longitudinal direction of the main casing (61) to cover almost the entire length of the main casing (61). The tray units (10) contained in the main casing (61) are placed on the roller conveyor (65), and are transferred from the right to the left by the roller conveyor (65).

To the main casing (61), are connected air intake ducts (76, 86) for supplying air into the zones (71-74, 81, 82), and air exhaust ducts (77, 87) for discharging the air from the zones (71-74, 81, 82). In the main casing (61), 10 air intake ducts (76) and 10 air exhaust ducts (77) are connected to each of the drying zones (71-74). Further, 10 air intake ducts (86) and 10 air exhaust ducts (87) are connected to each of the thermal treatment zones (81, 82) in the main casing (61).

The air intake ducts (76, 86) are connected to a rearward side surface (i.e., a rear surface) of the main casing (61), and are opened in the corresponding zones (71-74, 81, 82). With the tray units (10) contained in the zones (71-74, 81, 82), three pairs of air intake ducts (76, 86) are positioned between the adjacent transfer trays (14) in each of the tray units (10), respectively, a pair of air intake ducts (76, 86) are positioned above the uppermost transfer tray (14), and a pair of air intake ducts (76, 86) are positioned below the lowermost transfer tray (14).

The air exhaust ducts (77, 87) are connected to a frontward side surface (i.e., a front surface) of the main casing (61), and are opened in the corresponding zones (71-74, 81, 82). With the tray units (10) contained in the zones (71-74, 81, 82), three pairs of air exhaust ducts (77, 87) are positioned between the adjacent transfer trays (14) in each of the tray units (10), respectively, a pair of air exhaust ducts (77, 87) are positioned above the uppermost transfer tray (14), and a pair of air exhaust ducts (77, 87) are positioned below the lowermost transfer tray (14).

—Working Mechanism—

A working mechanism of the production apparatus (1) of the present embodiment will be described. The production apparatus (1) performs drying wet PTFE powder produced by polymerization, and thermally heating the dried PTFE powder.

Moisture content mentioned in the following description is a percentage of mass of water to the PTFE powder. Specifically, provided that the wet PTFE powder is a mixture of PTFE powder of a mass of $W_1$ and water of a mass of $W_2$, moisture content R of the wet PTFE powder is obtained by the following equation:

$$R=(W_2/W_1)\times 100$$

The transfer tray (14) carries the wet PTFE powder produced by the polymerization. The PTFE powder placed on the transfer tray (14) has a moisture content of about 80%. The wet PTFE powder placed on the transfer tray (14) is flattened. Each of the tray racks (11) carries four transfer trays (14) each carrying the wet PTFE powder. As described above, one tray rack (11) and four transfer trays (14) form a single tray unit (10). The tray units (10) enter the production apparatus (1) of the present embodiment one by one every 15 minutes.

The tray unit (10) enters the first irradiation zone (31) of the former unit (20) every 15 minutes, and the tray unit (10) exits from the fourth irradiation zone (34) every 15 minutes. In the former unit (20), the tray units (10) contained in the first, second and third irradiation zones (31, 32, 33), respectively, are transferred every 15 minutes to the second, third, and fourth irradiation zones (32, 33, 34) on the right, respectively.

In the former unit (20), the microwave is applied to the tray units (10) contained in the irradiation zones (31-34) by the corresponding microwave irradiators (40, 45, 50, 55). The microwave generated by the corresponding microwave irradiators (40, 45, 50, 55) arrives at the wet PTFE powder on each of the transfer trays (14) in the irradiation zones (31-34), and is absorbed by the moisture contained in the PTFE powder. The moisture generates heat to evaporate as it absorbs the microwave.

In the former unit (20), outside air heated to about 60-100° C. is blown into the irradiation zones (31-34) through the air intake ducts (36), and air inside the irradiation zones (31-34) containing the evaporated moisture (water vapor) is sucked into the air exhaust ducts (37). The air sucked into the air exhaust ducts (37) is all discharged outside the apparatus. The air sucked into the air exhaust ducts (37) is released outside the apparatus after a suitable treatment, such as removal of harmful substances, etc., is done.

Focusing on one of the tray units (10), a working mechanism of the former unit (20) will be described below.

The tray unit (10) enters the former unit (20). Specifically, the inlet door (22) of the former unit (20) is opened, and then the tray unit (10) enters the first irradiation zone (31). The tray unit (10) entered the first irradiation zone (31) is placed on the roller conveyor (25). Then, the inlet door (22), the outlet door (23), and the partition doors (24) of the former unit (20) are all closed, and the microwave irradiators (40, 45, 50, 55) start application of the microwave.

The first microwave irradiator (40) applies the microwave to the tray unit (10) in the first irradiation zone (31). The microwave generated by the microwave oscillators (41) of the first microwave irradiator (40) passes the waveguides (42), and is applied to the transfer trays (14) in the tray unit (10) through the irradiation ports (43). Specifically, the microwave is applied from the left to the transfer trays (14) in the tray unit (10) in the first irradiation zone (31). The moisture contained in the PTFE powder on the transfer trays (14) in the first irradiation zone (31) is heated to evaporate, and the evaporated moisture is sucked into the air exhaust ducts (37).

After a lapse of 15 minutes from the start of the microwave application in the former unit (20), the microwave application by the microwave irradiators (40, 45, 50, 55) is suspended. Then, the partition doors (24) of the former unit (20) are opened, and the tray unit (10) is transferred from the first irradiation zone (31) to the second irradiation zone (32). The partition doors (24) are closed after the tray unit (10) is moved to the second irradiation zone (32), and the microwave application by the microwave irradiators (40, 45, 50, 55) is restarted.

The second microwave irradiator (45) applies the microwave to the tray unit (10) in the second irradiation zone (32). The microwave generated by the microwave oscillators (46) of the second microwave irradiator (45) passes the waveguides (47), and is applied to the transfer trays (14) in the tray unit (10) through the irradiation ports (48). Specifically, the microwave is applied from behind to the transfer trays (14) in the tray unit (10) in the second irradiation zone (32). The moisture contained in the PTFE powder on the transfer trays (14) in the second irradiation zone (32) is heated to evaporate, and the evaporated moisture is sucked into the air exhaust ducts (37).

After a lapse of 15 minutes from the restart of the microwave application in the former unit (20), the microwave application by the microwave irradiators (40, 45, 50, 55) is suspended. Then, the partition doors (24) of the former unit (20) are opened, and the tray unit (10) is transferred from the second irradiation zone (32) to the third irradiation zone (33). The partition doors (24) are closed after the tray unit (10) is moved to the third irradiation zone (33), and the microwave application by the microwave irradiators (40, 45, 50, 55) is restarted.

The third microwave irradiator (50) applies the microwave to the tray unit (10) in the third irradiation zone (33). The microwave generated by the microwave oscillators (51) of the third microwave irradiator (50) passes the waveguides (52), and is applied to the transfer trays (14) in the tray unit (10) through the irradiation ports (53). Specifically, the microwave is applied from the front to the transfer trays (14) in the tray unit (10) in the third irradiation zone (33). The moisture contained in the PTFE powder on the transfer trays (14) in the third irradiation zone (33) is heated to evaporate, and the evaporated moisture is sucked into the air exhaust ducts (37).

After a lapse of 15 minutes from the restart of the microwave application in the former unit (20), the microwave application by the microwave irradiators (40, 45, 50, 55) is suspended. Then, the partition doors (24) of the former unit (20) are opened, and the tray unit (10) is transferred from the third irradiation zone (33) to the fourth irradiation zone (34). The partition doors (24) are closed after the tray unit (10) is moved to the fourth irradiation zone (34), and the microwave application by the microwave irradiators (40, 45, 50, 55) is restarted.

The fourth microwave irradiator (55) applies the microwave to the tray unit (10) in the fourth irradiation zone (34). The microwave generated by the microwave oscillators (56) of the fourth microwave irradiator (55) passes the waveguides (57), and is applied to the transfer trays (14) in the tray unit (10) through the irradiation ports (58). Specifically, the microwave is applied from the right to the transfer trays (14) in the tray unit (10) in the fourth irradiation zone (34). The moisture contained in the PTFE powder on the transfer trays (14) in the fourth irradiation zone (34) is heated to evaporate, and the evaporated moisture is sucked into the air exhaust ducts (37).

After a lapse of 15 minutes from the restart of the microwave application in the former unit (20), the microwave application by the microwave irradiators (40, 45, 50, 55) is suspended. Then, the outlet door (23) of the former unit (20) is opened, and the tray unit (10) exits from the fourth irradiation zone (34). The PTFE powders placed on the transfer trays (14) in the tray unit (10) exited from the fourth irradiation zone (34) have a moisture content of about 5%.

In this way, in the former unit (20), the microwave application to the transfer trays (14) is performed from the left in the first irradiation zone (31), from behind in the second irradiation zone (32), from the front in the third irradiation zone (33), and from the right in the fourth irradiation zone (34). Specifically, the direction of microwave application to the transfer trays (14) varies by 90° as the tray unit (10) sequentially moves from the first irradiation zone (31) to the fourth irradiation zone (34) of the former unit (20).

The tray unit (10) exited from the fourth irradiation zone (34) of the former unit (20) enters the first drying zone (71) of the latter unit (60), and is placed on the roller conveyor (65). In the latter unit (60), the tray unit (10) enters the first drying zone (71) every 15 minutes, and the tray unit (10) exits from the second thermal treatment zone (82) every 15 minutes. The inlet door (62) is opened to allow the tray unit (10) to enter the first drying zone (71), and the outlet door (63) is opened to allow the tray unit (10) to exit from the second thermal treatment zone (82).

In the latter unit (60), the tray units (10) contained in the first, second, and third drying zones (71, 72, 73), respectively, are transferred every 15 minutes to the second, third and fourth drying zones (72, 73, 74) on the left, respectively. In the latter unit (60), the tray unit (10) contained in the fourth drying zone (74) is transferred to the first thermal treatment zone (81) every 15 minutes, and the tray unit (10) contained in the first thermal treatment zone (81) is transferred to the second thermal treatment zone (82) every 15 minutes.

In the latter unit (60), air heated to a predetermined temperature of about 100-250° C. (preferably about 130-200° C.) is blown into the drying zones (71-74) through the air intake ducts (76). The PTFE powder on each of the transfer trays (14) in the drying zones (71-74) is heated by the air supplied through the air intake ducts (76), thereby evaporating moisture contained in the PTFE powder. The air inside the drying zones (71-74) containing the evaporated moisture (water vapor) is sucked into the air exhaust ducts (77). A portion of the air sucked into the air exhaust ducts (77) (e.g., 2% of the total) is discharged outside the apparatus, and the remaining portion is mixed with outside air, and is sent back to the drying zones (71-74) through the air intake ducts (76). The air sucked into the air exhaust ducts (77) and discharged outside the apparatus is released outside after a suitable treatment, such as removal of harmful substances, etc., is done.

In the latter unit (60), the PTFE powder on each of the transfer trays (14) is kept exposed to the hot air of the predetermined temperature while the tray unit (10) is transferred from the first drying zone (71) to the fourth drying zone (74) (i.e., for about 60 minutes). The moisture content of the PTFE powder on each of the transfer trays (14) in the tray unit (10) moving from the fourth drying zone (74) to the first thermal treatment zone (81) is as low as about 0.01% or lower.

In the latter unit (60), air heated to the predetermined temperature of about 100-250° C. (preferably about 130-200° C.) is blown into the thermal treatment zones (81, 82) through the air intake ducts (86), and the air in the thermal treatment zones (81, 82) is sucked into the air exhaust ducts (87). The air sucked into the air exhaust ducts (87) is all reheated up to the predetermined temperature, and is sent back to the thermal treatment zones (81, 82) through the air intake ducts (86). Therefore, the temperature in the thermal treatment zones (81, 82) is kept almost equal to the temperature of the hot air blown from the air intake ducts (86), thereby keeping the temperature of the PTFE powder on the transfer trays (14) in the thermal treatment zones (81, 82) almost equal to the temperature. In the latter unit (60), the PTFE powder on each of the transfer trays (14) is kept at a high temperature of 100° C. or higher while the tray unit (10) moves from the first thermal treatment zone (81) to the second thermal treatment zone (82) (i.e., about 30 minutes).

When the temperature of the PTFE powder whose moisture content is reduced to about 0% is kept at a certain high temperature, extrusion pressure (pressure required for extruding the PTFE powder) gradually increases in an early stage. Then, after a lapse of a certain period of time, the extrusion pressure no longer increases, and remains constant. From this point of view, in the latter unit (60), the temperature of the PTFE powder is kept as high as 100° C. or higher for a period of time longer than the period of time required until the extrusion pressure of the PTFE powder becomes constant. The thermal treatment allows for setting the extrusion pressure of the finally obtained PTFE powder within a predetermined target range.

Thus, the wet PTFE powder on the transfer trays entered the production apparatus (1) of the present embodiment is converted to dried PTFE powder as a final product through the drying process using the microwave performed in the irradiation zones (31-34) of the former unit (20), the drying process using the hot air in the drying zones (71-74) of the latter unit (60), and the thermal treatment process using the hot air in the thermal treatment zones (81, 82) of the latter unit (60).

Advantages of First Embodiment

According to the present embodiment, four vertically aligned transfer trays (14) constitute the tray unit (10), and the tray unit (10) enters the production apparatus (1). Therefore, as compared with an apparatus in which all the transfer trays (14) to be treated are aligned in the horizontal direction one by one, the production apparatus (1) of the present embodiment can reduce a floor area required to contain the transfer trays (14) to about ¼. Thus, the present embodiment makes it possible to drastically reduce the floor area occupied by the former unit (20) and the latter unit (60) containing the transfer trays (14), thereby downsizing the production apparatus (1).

An electromagnetic wave, such as the microwave, is inherently impossible to pass through "a gap between metallic objects sufficiently smaller than the wavelength of the electromagnetic wave", such as interstices of a metal mesh. Therefore, if the distance between the vertically aligned metallic transfer trays (14) is small, the microwave is less likely to enter the gap between the adjacent transfer trays (14), resulting in insufficient heating of an object on the transfer trays (14) by the microwave.

In contrast, according to the present embodiment, the distance H between the transfer trays (14) placed on the tray rack (11) of each of the tray units (10) is set to $\lambda/2$ or larger (see FIG. 5). Further, in the former unit (20) of the present embodiment, the distance H between the ceiling surface of the metallic main casing (21) and the uppermost transfer tray (14) in the tray unit (10) is also set to $\lambda/2$ or larger (see FIG. 5).

Specifically, in the former unit (20) of the present embodiment, a sufficient distance H in the vertical direction is provided between the transfer trays (14), and between the transfer tray (14) and the main casing (21). Therefore, the microwave laterally applied to the vertically aligned metallic transfer trays (14) is not disturbed by the transfer trays (14), but arrives at the moisture in the PTFE powder on the transfer trays (14). Thus, the present embodiment makes it possible to reliably heat the moisture contained in the PTFE powder on each of the transfer trays (14), thereby reliably reducing the moisture content in the PTFE powder on each of the transfer trays (14).

In the former unit (20) of the present embodiment, the distance L between the inner wall surface of the main casing (21) and the side plates (16) of the transfer trays (14) is set to $\lambda$ or larger. Specifically, according to the present embodiment, a sufficient distance is provided between the main casing (21) and the transfer trays (14) in the direction of microwave application. Therefore, the microwave laterally applied to the transfer trays (14) can be dispersed and distributed to the transfer trays (14). Thus, the present invention makes it possible to evenly heat the moisture in the PTFE powder on each of the transfer trays (14), thereby averaging the moisture content in the PTFE powder on each of the transfer trays (14).

If the transfer trays (14) are made of a resin or the like that exhibits relatively high permeability to the microwave, the microwave can arrive at the moisture in the PTFE powder on the transfer trays (14), even if the distance between the transfer trays (14) or the distance between the transfer trays (14) and the main casing (21) is not very large. However, since the resin is generally not as strong as metal, the transfer trays (14) made of the resin will be heavier than the transfer trays (14) made of metal. Moreover, the resin transfer trays (14) may possibly be chipped when they are in use. If a chip of the transfer tray (14) is mixed in the PTFE powder, it will be a foreign matter mixed in the PTFE powder. This may possibly lead to decrease in quality of the finally obtained PTFE powder.

In the production apparatus (1) of the present embodiment, the transfer trays (14) are made of stainless steel, a type of metal. Therefore, the transfer trays (14) can be lighter than the resin transfer trays (14), thereby allowing for easy handling of the transfer trays (14). Further, the transfer trays (14) made of stainless steel will not be chipped when they are in use, thereby avoiding decrease in quality of the PTFE powder due to mixing of the foreign matter.

In the present embodiment, the microwave is applied to the transfer trays (14) contained in the former unit (20) in multiple directions. In each of the irradiation zones (31-34) of the former unit (20), the applied microwave is gradually absorbed by the moisture in the PTFE powder. Therefore, in each of the irradiation zones (31-34), the energy of the microwave is attenuated as the microwave travels away from the irradiation ports (43, 48, 53, 58), which are outlets of the microwave. Since the microwave is applied in the multiple directions to the transfer trays (14) in the former unit (20), the present embodiment makes it possible to evenly heat the moisture in each of the PTFE powders placed on the transfer trays (14), thereby averaging the moisture contents in the PTFE powders on the transfer trays (14).

In the former unit (20) of the present embodiment, the microwave is applied in four directions, from the front, back, left, and right, to the rectangular transfer trays (14) placed in the substantially horizontal state. Therefore, the energy of the microwave applied to the moisture in the PTFE powder is reliably averaged on every part of the transfer tray (14). Thus, the present embodiment makes it possible to average the moisture content in the PTFE powder on every part of the transfer tray (14), thereby drying every part of the PTFE powder on the transfer tray (14) with reliability.

In the former unit (20) of the present embodiment, the irradiation ports (43, 48, 53, 58) are provided for the transfer trays (14) contained in the single tray unit (10) in one-to-one correspondence. Therefore, the energy of the microwave applied to the objects on the transfer trays (14) can be averaged, thereby equalizing the moisture contents in the objects on the transfer trays (14).

First Modified Example of First Embodiment

Figure 7:
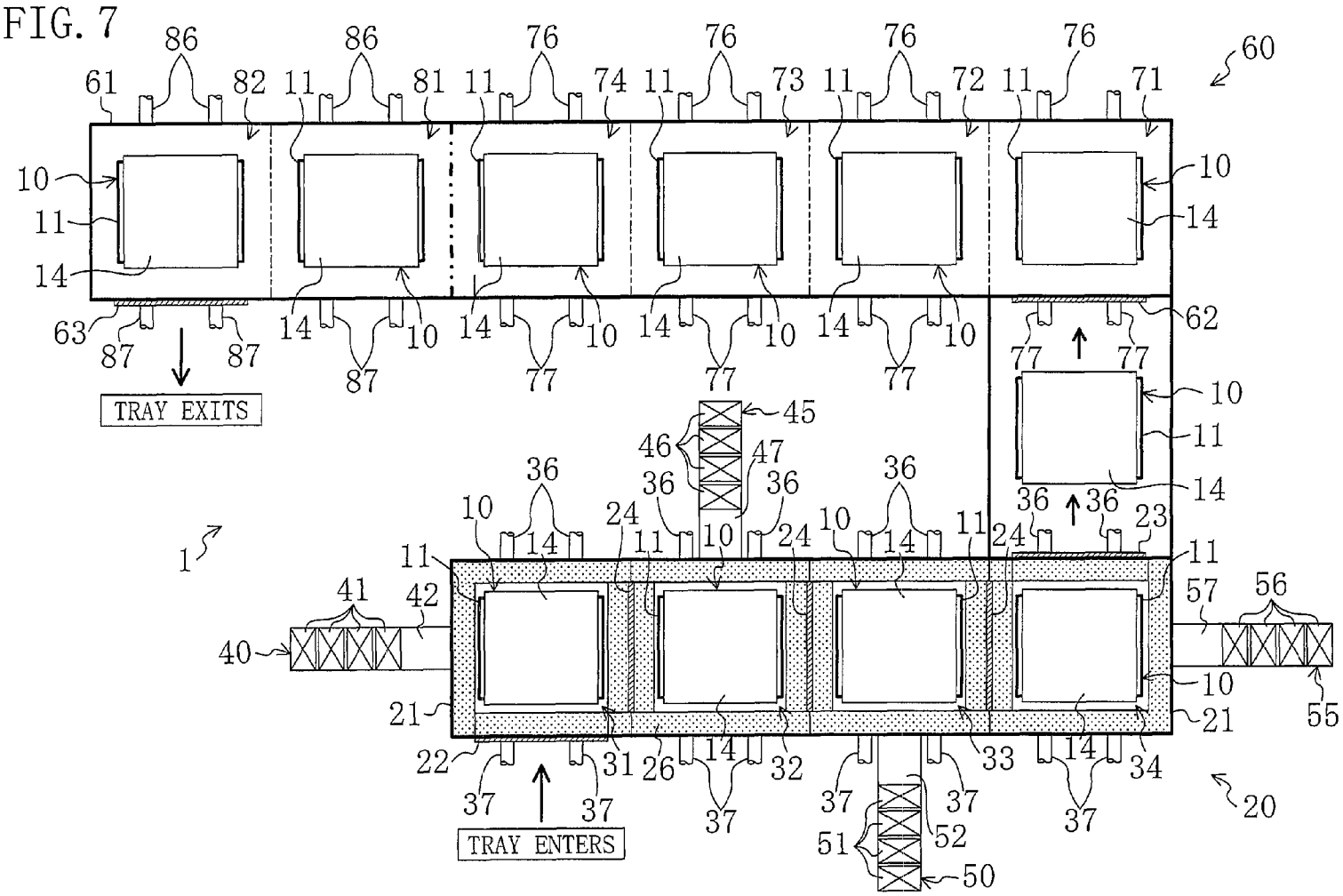
FIG. 7 is a front view illustrating a modified example of the production apparatus of the first embodiment, partially omitted.

The production apparatus (1) of the present embodiment may be modified by arranging the former unit (20) and the latter unit (60) in the fore-and-aft direction as shown in FIG. 7.

In the former unit (20) of this modified example, the outlet door (23) is arranged on the rear surface of the main casing (21) to face the fourth irradiation zone (34). In the latter unit (60) of this modified example, the inlet door (62) is arranged on the front surface of the main casing (61) to face the first drying zone (71).

In the production apparatus (1) of this modified example, the former unit (20) and the latter unit (60) are arranged at predetermined intervals in the fore-and-aft direction with their longitudinal directions parallel to each other. The former unit (20) and the latter unit (60) are arranged with the outlet door (23) of the former unit (20) and the inlet door (62) of the latter unit (60) facing each other. The tray unit (10) exited from the fourth irradiation zone (34) of the former unit (20) is transferred rearward to enter the first drying zone (71) of the latter unit (60).

Second Modified Example of First Embodiment

In the production apparatus (1) of the present embodiment, the number of the transfer trays (14) contained in the single tray unit (10) is not limited to four, but the number can be determined as required. For example, six transfer trays (14) may be contained in the single tray unit (10). In this case, each of the microwave irradiators of the former unit (20) is provided with six microwave oscillators and six waveguides. Further, irradiation ports are formed in the inner wall surface of the main casing (21) in such a manner that one irradiation port is provided immediately above each of the transfer trays (14) in the tray units (10) contained in the irradiation zones (31-34).

Second Embodiment

A second embodiment of the present invention will be described. This embodiment is achieved by changing the structure of the production apparatus (1) of the first embodiment. Hereinafter, difference between the production apparatus (1) of the present embodiment from that of the first embodiment will be described. In the following description, "right," "left," "front," "rear," "frontward," and "rearward" are directions relative to the production apparatus (1) viewed from the front.

Figure 8:
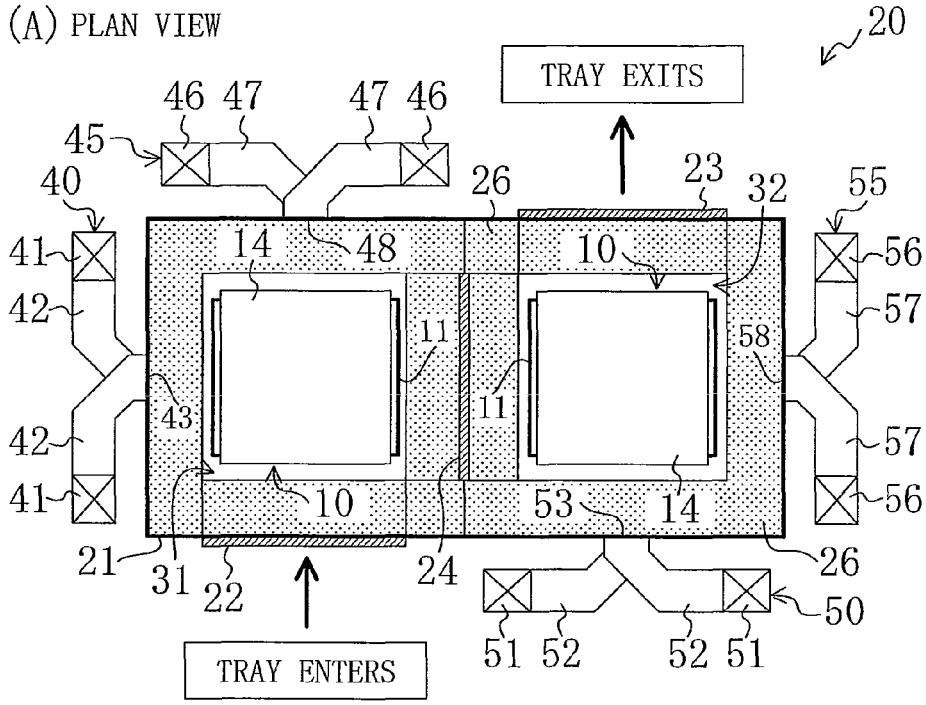
FIGS. 8(A) and 8(B) are a plan view and a front view, both of which illustrating a former unit of a second embodiment, partially omitted.
Figure 8:
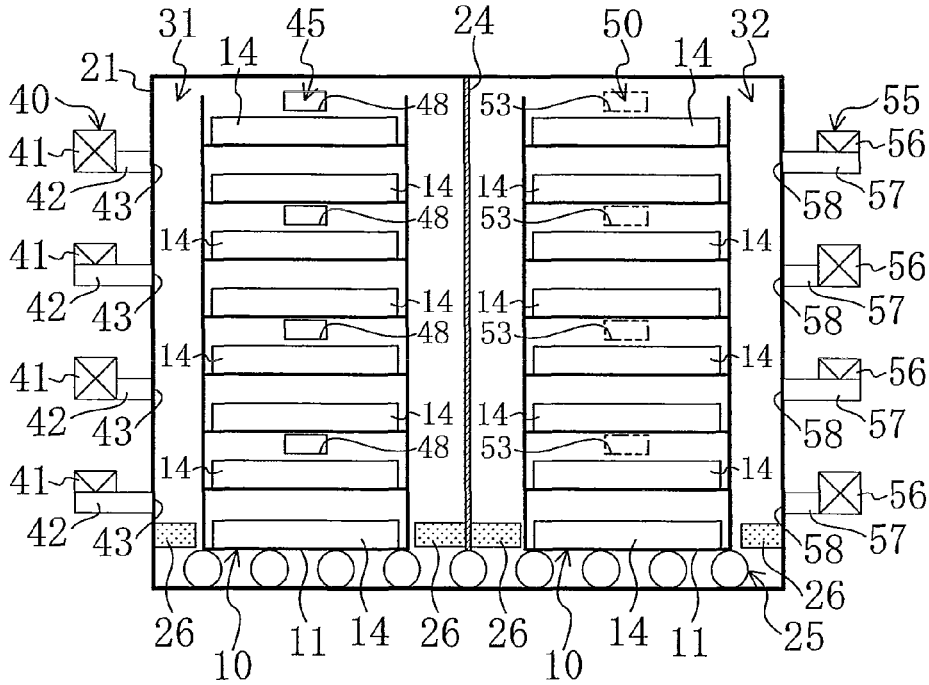

As shown in FIG. 8, in the present embodiment, a single tray unit (10) carries eight transfer trays (14). The tray rack (11) in the tray unit (10) includes eight frame members (12) vertically aligned at predetermined intervals, thereby aligning the eight transfer trays (14) in the vertical direction at regular intervals H.

In the former unit (20) of the present embodiment, the lateral length of the main casing (21) is approximately half the length of the main casing of the first embodiment, and the height of the main casing (21) is approximately double the height of the main casing of the first embodiment. In space inside the main casing (21), one partition door (24) is provided at the lateral center of the main casing. The inside space is divided into two rooms by the partition door (24). The room in the main casing on the left of the partition door (24) is a first irradiation zone (31), and the room on the right of the partition door (24) is a second irradiation zone (32). Each of the irradiation zones (31, 32) is as large as it can contain one tray unit (10).

The partition door (24) is a flat, rectangular stainless steel plate corresponding to the cross sectional shape of the main casing (21). The partition door (24) is opened/closed as it moves in the vertical direction. When the partition door (24) is opened, the first irradiation zone (31) and the second irradiation zone (32) communicate with each other.

The main casing (21) of the former unit (20) of the present embodiment is also provided with an inlet door (22) and an outlet door (23). The inlet door (22) is arranged on a front surface of the main casing (21) to face the first irradiation zone (31). The inlet door (22) is a flat, rectangular stainless steel plate, and is opened/closed as it moves in the vertical direction. When the inlet door (22) is opened, the first irradiation zone (31) communicates with the outside of the main casing (21). The outlet door (23) is arranged on a rearward side surface (i.e., a rear surface) of the main casing (21) to face the second irradiation zone (32). The outlet door (23) is a flat, rectangular stainless steel plate, and is opened/closed as it moves in the vertical direction. When the outlet door (23) is opened, the second irradiation zone (32) communicates with the outside of the main casing (21).

Although not shown, air intake ducts and air exhaust ducts are connected also to the main casing (21) of the former unit (20) of the present embodiment. The air intake ducts are connected to the rearward side surface (i.e., the rear surface) of the main casing (21). A predetermined number of air intake ducts are connected to the rear surface of the main casing (21) to face the first irradiation zone (31) and the second irradiation zone (32), respectively. The air exhaust ducts are connected to the front surface of the main casing (21). A predetermined number of air exhaust ducts is connected to the front surface of the main casing (21) to face the first irradiation zone (31) and the second irradiation zone (32), respectively.

The former unit (20) of the present embodiment includes four microwave irradiators (40, 45, 50, 55). Each of the microwave irradiators (40, 45, 50, 55) includes microwave oscillators (41, 46, 51, 56) and waveguides (42, 47, 52, 57) of half the number of the transfer trays (14) contained in the single tray unit (10). In the present embodiment, eight transfer trays (14) are contained in the single tray unit (10). Therefore, each of the microwave irradiators (40, 45, 50, 55) of the present embodiment includes four microwave oscillators (41, 46, 51, 56) and four waveguides (42, 47, 52, 57).

The first microwave irradiator (40) is arranged on the left side surface of the main casing (21). Specifically, terminal ends of the waveguides (42) of the first microwave irradiator (40) are connected to the left side surface of the main casing (21). The terminal ends of the waveguides (42) serve as irradiation ports (43) opened in the first irradiation zone (31). In the inner wall surface of the main casing (21), the irradiation ports (43) are opened between the first and second uppermost transfer trays (14), between the third and fourth uppermost transfer trays (14), between the fifth and sixth uppermost transfer trays (14), and between the seventh and eighth uppermost transfer trays (14) in the tray unit (10), respectively.

The second microwave irradiator (45) is arranged on a rearward side surface (i.e., a rear surface) of the main casing (21). Specifically, terminal ends of the waveguides (47) of the second microwave irradiator (45) are connected to the rear surface of the main casing (21). The terminal ends of the waveguides (47) serve as irradiation ports (48) opened in the first irradiation zone (31). In the inner wall surface of the main casing (21), the irradiation ports (48) are opened between the uppermost transfer tray (14) in the tray unit (10) and a ceiling surface of the main casing (21), between the second and third uppermost transfer trays (14), between the fourth and fifth uppermost transfer trays (14), and between the sixth and seventh uppermost transfer trays (14), respectively.

The third microwave irradiator (50) is arranged on the front surface of the main casing (21). Specifically, terminal ends of the waveguides (52) of the third microwave irradiator (50) are connected to the front surface of the main casing (21). The terminal ends of the waveguides (52) serve as irradiation ports (53) opened in the second irradiation zone (32). In the inner wall surface of the main casing (21), the irradiation ports (53) are opened between the uppermost transfer tray (14) in the tray unit (10) and the ceiling surface of the main casing (21), between the second and third uppermost transfer trays (14), between the fourth and fifth uppermost transfer trays (14), and between the sixth and seventh uppermost transfer trays (14), respectively.

The fourth microwave irradiator (55) is arranged on a right side surface of the main casing (21). Specifically, terminal ends of the waveguides (57) of the fourth microwave irradiator (55) are connected to the right side surface of the main casing (21). The terminal ends of the waveguide (57) serve as irradiation ports (58) opened in the second irradiation zone (32). In the inner wall surface of the main casing (21), the irradiation ports (58) are opened between the first and second uppermost transfer trays (14), between the third and fourth uppermost transfer trays (14), between the fifth and sixth uppermost transfer trays (14), and between the seventh and eighth uppermost transfer trays (14) in the tray unit (10), respectively.

A shielding frame (26) is also arranged in each of the irradiation zones (31, 32) of the main casing (21) of the present embodiment. In the same manner as described in the first embodiment, the shielding frame (26) is arranged to surround the lowermost transfer tray (14) in the tray unit (10), with the inner circumferential surface thereof facing the side plates (16) of the lowermost transfer tray (14).

In the former unit (20) of the present embodiment, a distance H between the vertically aligned transfer trays (14) in the tray unit (10), and a distance H between the uppermost transfer tray (14) in the tray unit (10) and the ceiling surface of the main casing (21) are both set to a value of $\lambda/2$ or larger. In the former unit (20), a distance L between the inner wall surface of the main casing (21) or the partition door (24) and the side plates of the transfer trays (14) is set to a value of $\lambda$ or larger. Further, in the former unit (20), a distance D between the side plates (16) of the lowermost transfer tray (14) in the tray unit (10) and the inner circumferential surface of the shielding frame (26) is set to a certain value that does not allow the microwave to pass through a gap between them.

Although not shown, in the latter unit (60) of the present embodiment, the height of the main casing (61) is almost double the height of the main casing of the first embodiment. The main casing (61) is configured to contain the tray unit (10) of the present embodiment containing eight transfer trays (14). In the same manner as described in the first embodiment, four drying zones (71-74) and two thermal treatment zones (81, 82) are aligned in a row in the main casing (61) of the latter unit (60) of the present embodiment.

—Working Mechanism—

A working mechanism of the former unit (20) of the present embodiment will be described. The latter unit (60) of the present embodiment works in the same manner as the latter unit of the first embodiment.

In the former unit (20), the tray unit (10) enters the first irradiation zone (31) every 30 minutes, and the tray unit (10) exits from the second irradiation zone (32) every 30 minutes. Further, in the former unit (20), the tray unit (10) contained in the first irradiation zone (31) is transferred to the second irradiation zone (32) on the right thereof every 30 minutes.

In each of the irradiation zones (31, 32) of the former unit (20), the microwave is applied to the tray unit (10) contained therein by the corresponding microwave irradiators (40, 45, 50, 55). In each of the irradiation zones (31, 32), the microwave applied from the microwave irradiators (40, 45, 50, 55) arrives at the wet PTFE powder on each of the transfer trays (14), and is absorbed by the moisture contained in the PTFE powder. The moisture generates heat to evaporate as it absorbs the microwave.

In the former unit (20), outside air heated to about 60-100° C. is blown into the irradiation zones (31, 32) through the air intake ducts, and the air inside the irradiation zones (31, 32) containing the evaporated moisture (water vapor) is sucked into the air exhaust ducts. The air sucked into the air exhaust ducts is all discharged outside the apparatus. The air sucked into the air exhaust ducts is released outside the apparatus after a suitable treatment, such as removal of harmful substances, etc., is done.

Focusing on one of the tray units (10), a working mechanism of the former unit (20) will be described below.

The tray unit (10) enters the former unit (20). Specifically, the inlet door (22) of the former unit (20) is opened, and then the tray unit (10) enters the first irradiation zone (31). The tray unit (10) entered the first irradiation zone (31) is placed on the roller conveyor (25). Then, the inlet door (22), the outlet door (23), and the partition door (24) of the former unit (20) are all closed, and the microwave irradiators (40, 45, 50, 55) start application of the microwave.

The first microwave irradiator (40) and the second microwave irradiator (45) apply the microwave to the tray unit (10) in the first irradiation zone (31). The moisture contained in the PTFE powder on each of the transfer trays (14) in the first irradiation zone (31) evaporates, and the evaporated moisture is sucked into the air exhaust ducts.

Specifically, the microwave generated by the microwave oscillators (41) of the first microwave irradiator (40) passes the waveguides (42), and is applied to the transfer trays (14) in the tray unit (10) through the irradiation ports (43). Specifically, the first microwave irradiator (40) applies the microwave from the left mainly to the second, fourth, sixth, and eighth uppermost transfer trays (14) in the tray unit (10).

On the other hand, the microwave generated by the microwave oscillators (46) of the second microwave irradiator (45) passes through the waveguides (47), and is applied to the transfer trays (14) in the tray unit (10) through the irradiation ports (48). The second microwave irradiator (45) applies the microwave from behind mainly to the first, third, fifth, and seventh uppermost transfer trays (14) in the tray unit (10).

After 30 minute microwave application in the former unit (20), the microwave application by the microwave irradiators (40, 45, 50, 55) is suspended. Then, the partition door (24) of the former unit (20) is opened, and the tray unit (10) is transferred from the first irradiation zone (31) to the second irradiation zone (32). The partition door (24) is closed after the tray unit (10) is moved to the second irradiation zone (32), and the microwave application by the microwave irradiators (40, 45, 50, 55) is restarted.

The third microwave irradiator (50) and the fourth microwave irradiator (55) apply the microwave to the tray unit (10) in the second irradiation zone (32). The moisture contained in the PTFE powder on each of the transfer trays (14) in the second irradiation zone (32) evaporates, and the evaporated moisture is sucked into the air exhaust ducts.

Specifically, the microwave generated by the microwave oscillators (51) of the third microwave irradiator (50) passes through the waveguides (52), and is applied to the transfer trays (14) in the tray unit (10) through the irradiation ports (53). The third microwave irradiator (50) applies the microwave from the front mainly to the first, third, fifth, and seventh uppermost transfer trays (14) in the tray unit (10).

On the other hand, the microwave generated by the microwave oscillators (56) of the fourth microwave irradiator (55) passes through the waveguides (57), and is applied to the transfer trays (14) in the tray unit (10) through the irradiation ports (58). The fourth microwave irradiator (55) applies the microwave from the right mainly to the second, fourth, sixth, and eighth uppermost transfer trays (14) in the tray unit (10).

After a lapse of 30 minutes from the restart of the microwave application in the former unit (20), the microwave application by the microwave irradiators (40, 45, 50, 55) is suspended. Then, the outlet door (23) of the former unit (20) is opened, and the tray unit (10) exits from the second irradiation zone (32).

In this way, the microwave is applied to the first, third, fifth and seventh uppermost transfer trays (14) in the tray unit (10) mainly from behind in the first irradiation zone (31), and mainly from the front in the second irradiation zone (32). Further, the microwave is applied to the second, fourth, sixth, and eighth uppermost transfer trays (14) in the tray unit (10) mainly from the left in the first irradiation zone (31), and mainly from the right in the second irradiation zone (32). Specifically, in the former unit (20) of the present embodiment, the direction of microwave application to the transfer trays (14) varies by 180° as the tray unit (10) moves from the first irradiation zone (31) to the second irradiation zone (32).

Advantages of Second Embodiment

The present embodiment can offer the similar advantages described in the first embodiment. In addition, the present embodiment can offer the following advantage. The additional advantage will be described below.

Provided that two irradiation ports are opened in a single irradiation zone to face each other, the microwave applied through one of the irradiation ports may enter the opposing irradiation port, thereby breaking the microwave oscillator connected to the opposing irradiation port.

In the former unit (20) of the present embodiment, however, the irradiation ports (43, 48, 53, 58) opened in the same irradiation zone (31, 32) are shifted from each other by 90° in the horizontal direction, and are shifted also in the vertical direction. Therefore, in one irradiation zone (31, 32) in which two of the microwave irradiators (40, 45, 50, 55) apply the microwave, the microwave applied by one of the microwave irradiators (40, 50) would not break the other microwave irradiator (45, 55). Therefore, the present embodiment makes it possible to ensure the reliability of the former unit (20) in which two microwave irradiators (40, 45, 50, 55) apply the microwave in each of the irradiation zones (31, 32).

Third Embodiment

A third embodiment of the present invention will be described. Hereinafter, difference of the production apparatus (1) of the present embodiment from that of the first embodiment will be described. In the following description, "right," "left," "front," "rear," "frontward," and "rearward" are directions relative to the production apparatus (1) viewed from the front.

Figure 9:
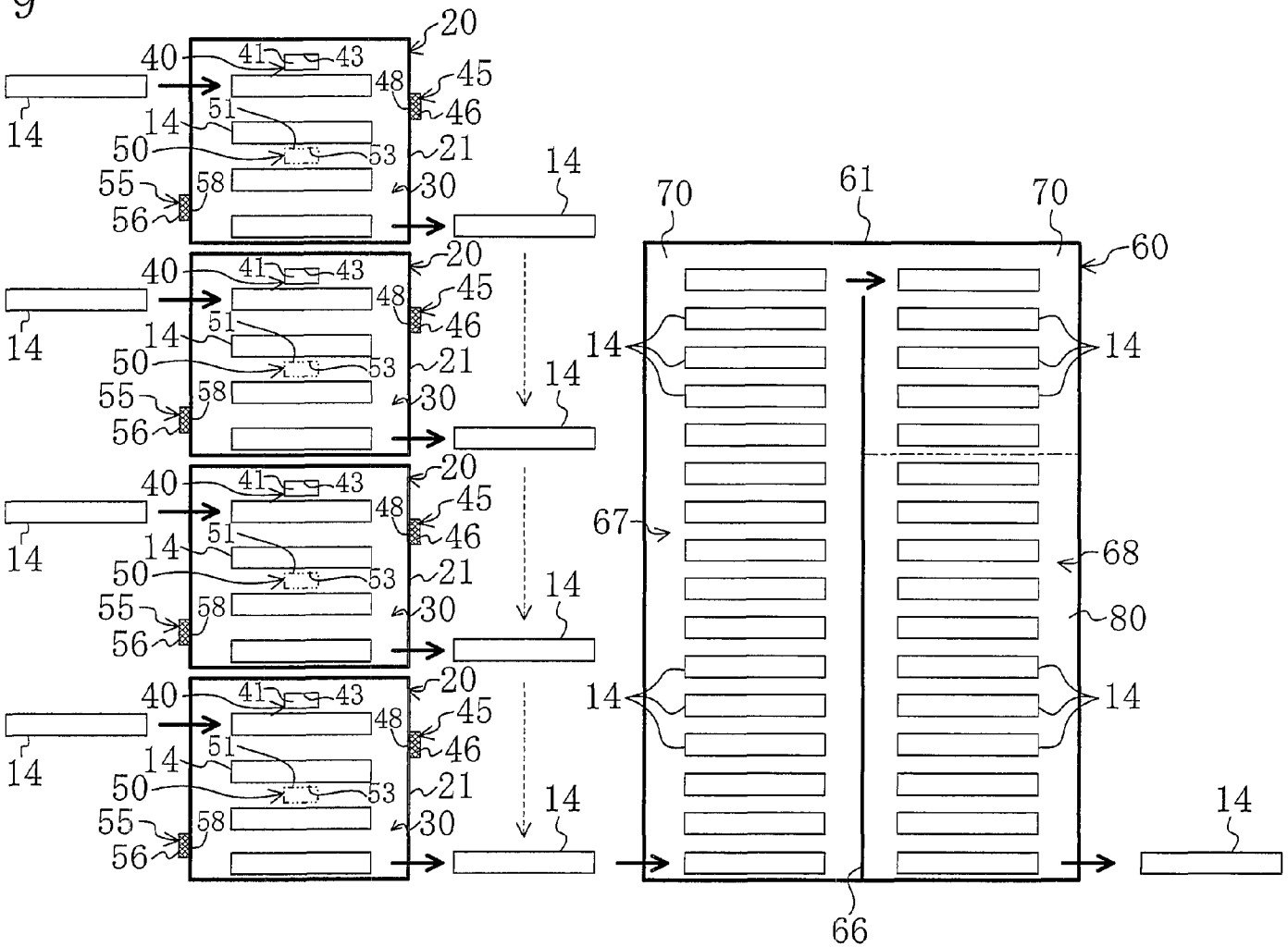
FIG. 9 is a front view illustrating a production apparatus of a third embodiment, partially omitted.

As shown in FIG. 9, the production apparatus (1) of the present embodiment includes four former units (20) and one latter unit (60). The four former units (20) are stacked in the vertical direction.

Figure 10:
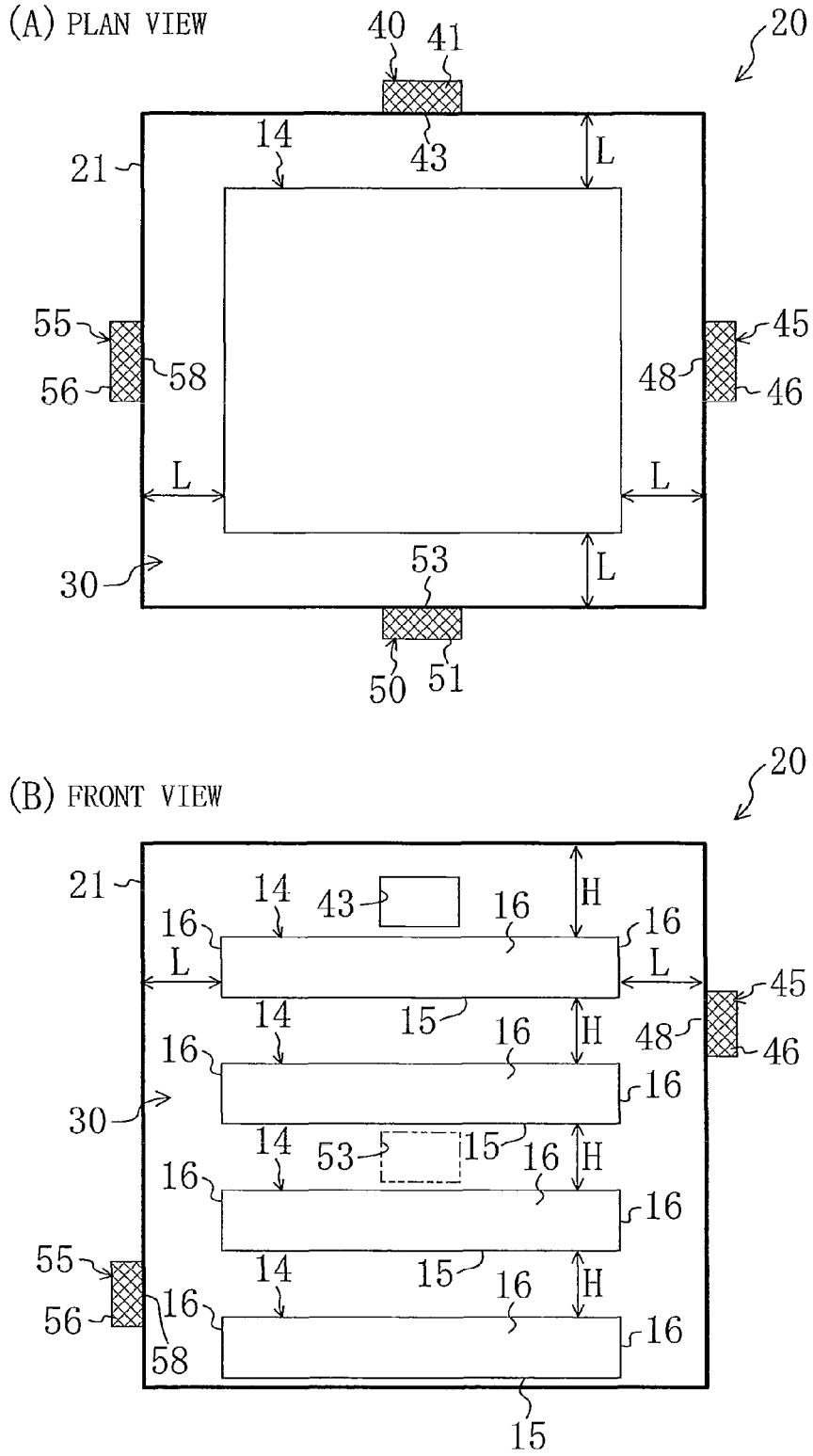
FIGS. 10(A) and 10(B) are a plan view and a front view, both of which illustrating a former unit of the third embodiment, partially omitted.

As shown in FIG. 10, a main casing (21) of each of the former units (20) is in the shape of a hollow rectangular parallelepiped. Space inside the main casing (21) forms an irradiation zone (30).

Each of the main casings (21) is as large as it can contain four transfer trays (14) vertically aligned at regular intervals H. With the four transfer trays (14) contained in the main casing (21), a distance between upper end surfaces of side plates (16) of the uppermost transfer tray (14) and a ceiling surface of the main casing (21) is set to the same value as the interval H between the vertically aligned transfer trays (14). A distance between each of the side plates (16) of the transfer trays (14) and an inner wall surface of the main casing (21) facing thereto is set to a length L in every circumferential direction of the transfer tray (14). In this embodiment, the main casings (21) and the transfer trays (14) are both made of stainless steel.

Although not shown, the former unit (20) includes a tray drive for transferring the transfer trays (14) in the irradiation zone (30). The tray drive includes an arm member which extends horizontally to carry the transfer tray (14) thereon. The tray drive includes a plurality of arm members arranged at regular intervals. The interval between the arm members is determined so that the distance between the transfer trays (14) placed on the arm members will be the predetermined value H. The tray drive moves the arm members carrying the transfer trays (14), thereby transferring the transfer trays (14) from the top to the bottom in the irradiation zone (30).

Each of the former units (20) is provided with four microwave irradiators (40, 45, 50, 55). Each of the microwave irradiators (40, 45, 50, 55) includes a single microwave oscillator (41, 46, 51, 56). In the present embodiment, the microwave oscillators (41, 46, 51, 56) are configured to generate a microwave of a frequency of 2.45 GHz at an output of about 1.0 kW.

The microwave oscillator (41) of the first microwave irradiator (40) is attached to a rearward side surface (i.e., a rear surface) of the main casing (21). An irradiation port (43) is opened in the rear surface of the main casing (21) between the uppermost transfer tray (14) and the ceiling surface of the main casing (21). The microwave oscillator (41) communicates with the irradiation zone (30) through the irradiation port (43).

The microwave oscillator (46) of the second microwave irradiator (45) is attached to a right side surface of the main casing (21). An irradiation port (48) is opened in the right side surface of the main casing (21) between the uppermost transfer tray (14) and the second uppermost transfer tray (14). The microwave oscillator (46) communicates with the irradiation zone (30) through the irradiation port (48).

The microwave oscillator (51) of the third microwave irradiator (50) is attached to a front surface of the main casing (21). An irradiation port (53) is opened in the front surface of the main casing (21) between the second uppermost transfer tray (14) and the third uppermost transfer tray (14). The microwave oscillator (51) communicates with the irradiation zone (30) through the irradiation port (53).

The microwave oscillator (56) of the fourth microwave irradiator (55) is attached to a left side surface of the main casing (21). An irradiation port (58) is opened in the left side surface of the main casing (21) between the third uppermost transfer tray (14) and the fourth uppermost transfer tray (14). The microwave oscillator (56) communicates with the irradiation zone (30) through the irradiation port (58).

Although not shown, an air intake duct and an air exhaust duct are connected also to the main casing (21) of the former unit (20) of the present embodiment. The air intake duct is connected to a rearward side surface (i.e., a rear surface) of the main casing (21). The air exhaust duct is connected to a front surface of the main casing (21). Outside air heated to about 60-100° C. is supplied to the irradiation zone (30) in the main casing (21) through the air intake duct. Air sucked into the air exhaust duct from the irradiation zone (30) is all discharged outside the apparatus. The air sucked into the air exhaust duct is released outside the apparatus after a suitable treatment, such as removal of harmful substances, etc, is done.

In the former unit (20) of the present embodiment, the distance H between the vertically aligned transfer trays (14) in the irradiation zone (30), and the distance H between the uppermost transfer tray (14) and the ceiling surface of the main casing (21) are both set to a value of $\lambda/2$ or larger. Further, in the former unit (20), the distance L between the inner wall surface of the main casing (21) and the side plates (16) of the transfer trays (14) is set to a value of $\lambda$ or larger. The former unit (20) of the present embodiment does not include the shielding frame (26).

In the latter unit (60) of the present embodiment, the main casing (61) is in the shape of a hollow, vertically oriented rectangular parallelepiped. A lateral dimension of the main casing (61) is almost double a fore-and-aft dimension thereof. In the main casing (61), a partition wall (66) is standing on the lateral center of the main casing (61). Space inside the main casing (61) is divided into a left ascending room (67) and a right descending room (68) by the partition wall (66). The height of the partition wall (66) is slightly smaller than the height of the space inside the main casing. That is, the ascending room (67) and the descending room (68) communicate with each other at their upper end portions.

In the main casing (61) of the latter unit (60), a plurality of transfer trays (14) are vertically aligned at predetermined intervals in each of the ascending room (67) and the descending room (68). Although not shown, the latter unit (60) includes a tray drive for transferring the transfer trays (14) in the main casing (61). The tray drive includes an arm member which extends horizontally to carry the transfer tray (14) thereon. The tray drive includes a plurality of arm members arranged at regular intervals. The tray drive moves the arm members carrying the transfer trays (14), thereby transferring the transfer trays (14). Specifically, the tray drive moves the transfer tray (14) sent in the ascending room (67) upward, sends the transfer tray (14) arrived at the upper end portion of the ascending room (67) to the descending room (68), and moves the transfer tray (14) sent in the descending room (68) downward.

A drying zone (70) and a thermal treatment zone (80) are formed in the space inside the main casing (61) of the latter unit (60). Specifically, in the space inside the main casing (61), the entire portion of the ascending room (67) and a portion of the descending room (68) extending a predetermined distance from the upper end thereof is the drying zone (70), and the remaining portion of the descending room (68) is the thermal treatment zone (80). However, the drying zone (70) and the thermal treatment zone (80) are virtually defined, and they are not physically divided by a partition or the like.

Although not shown, an air intake duct and an air exhaust duct communicating with the drying zone (70), and an air intake duct and an air exhaust duct communicating with the thermal treatment zone (80) are connected to the main casing (61) of the latter unit (60). Air of a predetermined temperature of about 100-250° C. (preferably about 130-200° C.) is blown into the drying zone (70) through the air intake duct. A portion of the air sucked into the air exhaust duct from the drying zone (70) is discharged outside the apparatus. The air is discharged outside the apparatus after a suitable treatment, such as removal of harmful substances, etc., is done.

The remaining portion of the air sucked into the air exhaust duct is mixed with outside air and reheated to the predetermined temperature, and then is sent back to the drying zone (70) through the air intake duct. Air of a predetermined temperature of about 100-250° C. (preferably about 130-200° C.) is supplied to the thermal treatment zone (80) through the air intake duct. The air sucked into the air exhaust duct from the thermal treatment zone (80) is all reheated to the predetermined temperature, and is sent back to the thermal treatment zone (80) through the air intake duct.

—Working Mechanism—

A working mechanism of the production apparatus (1) of the present embodiment will be described.

In each of the former units (20), the transfer trays (14) each carrying the wet PTFE powder enters the upper end portion of the irradiation zone (30) one by one every 15 minutes. In the irradiation zone (30), the transfer trays (14) move downward stage by stage every 15 minutes. Further, the transfer trays (14) exit from the lower end portion of the irradiation zone (30) of the former unit (20) one by one every 15 minutes.

In the former unit (20), the microwave irradiators (40, 45, 50, 55) apply the microwave to the transfer trays (14) contained in the irradiation zone (30) in the main casing (21). In the irradiation zone (30), moisture in the PTFE powder placed on each of the transfer trays (14) absorbs the microwave, and generates heat to evaporate. The moisture evaporated from the PTFE powder on the transfer trays (14) is discharged outside the apparatus together with the air inside the irradiation zone (30) through the air exhaust duct.

Focusing on one of the transfer trays (14), a working mechanism of the former unit (20) will be described below.

The transfer tray (14) carrying the wet PTFE powder is placed on the uppermost stage in the irradiation zone (30). The microwave mainly generated by the first microwave irradiator (40) is applied from behind to the transfer tray (14) on the uppermost stage. After a lapse of 15 minutes from the entrance of the transfer tray (14) in the irradiation zone (30), the transfer tray (14) moves downward by a single stage.

The microwave mainly generated by the second microwave irradiator (45) is applied from the right to the transfer tray (14) on the second uppermost stage. After a lapse of 15 minutes from the transfer to the second uppermost stage, the transfer tray (14) moves downward again by a single stage.

The microwave mainly generated by the third microwave irradiator (50) is applied from the front to the transfer tray (14) on the third uppermost stage. After a lapse of 15 minutes from the transfer to the third uppermost stage, the transfer tray (14) moves downward again by a single stage.

The microwave mainly generated by the fourth microwave irradiator (55) is applied from the left to the transfer tray (14) on the lowermost stage. After a lapse of 15 minutes from the transfer to the lowermost stage, the transfer tray (14) exits from the main casing (21) of the former unit (20). The transfer tray (14) exited from the former unit (20) enters the latter unit (60).

In this way, while the transfer tray (14) moves downward stage by stage in the former unit (20), the microwave is applied from behind to the transfer tray (14) on the uppermost stage, from the right to the transfer tray (14) on the second uppermost stage, from the front to the transfer tray (14) on the third uppermost stage, and from the left to the transfer tray (14) on the lowermost stage. That is, in the former unit (20), the direction of microwave application to the transfer tray (14) varies by 90° as the transfer tray (14) moves downward stage by stage.

In the production apparatus (1) of the present embodiment, the entrance of the transfer tray (14) in each of the former units (20) is shifted in time by 3 minutes and 45 seconds, and therefore, the exit of the transfer tray (14) from each of the former units (20) is shifted in time by 3 minutes and 45 seconds. The transfer trays (14) exited from the former units (20) enter the latter unit (60) one by one every 3 minutes and 45 seconds.

In the main casing (61) of the latter unit (60), the transfer tray (14) enters the lower end portion of the ascending room (67). The transfer tray (14) entered the lower end portion of the ascending room (67) (i.e., a starting end of the drying zone (70)) moves upward stage by stage in the drying zone (70). Upon arriving at the uppermost stage in the ascending room (67), the transfer tray (14) is transferred to the descending room (68), and moves downward stage by stage in the descending room (68). The transfer tray (14) moves in the descending room (68) by the number of predetermined stages, and arrives at a terminal end of the drying zone (70). While the transfer tray (14) moves from the starting end to the terminal end of the drying zone (70), the transfer tray (14) is kept exposed to hot air at a high temperature of 100° C. or higher. The moisture in the PTFE powder placed on the transfer tray (14) is heated to evaporate by the hot air.

The transfer tray (14) arrived at the terminal end of the drying zone (70) moves downward by one more stage, thereby arriving at a starting end of the thermal treatment zone (80). The transfer tray (14) entered the thermal treatment zone (80) moves downward stage by stage, and arrives at the lower end portion of the descending room (68) (i.e., a terminal end of the thermal treatment zone (80)). While the transfer tray (14) moves from the starting end to the terminal end of the thermal treatment zone (80), the transfer tray is kept exposed to hot air at a high temperature of 100° C. or higher. Therefore, the PTFE powder placed on the transfer tray (14) is kept to a temperature close to the temperature of the hot air. The transfer tray (14) arrived at the lower end portion of the descending room (68) exits from the main casing (61) of the latter unit (60).

Fourth Embodiment

A fourth embodiment of the present embodiment will be described. The production apparatus (1) of the present embodiment is achieved by changing the structure of the former unit (20) of the production apparatus (1) of the third embodiment. The structure of the latter unit (60) is the same as that of the third embodiment.

Figure 11:
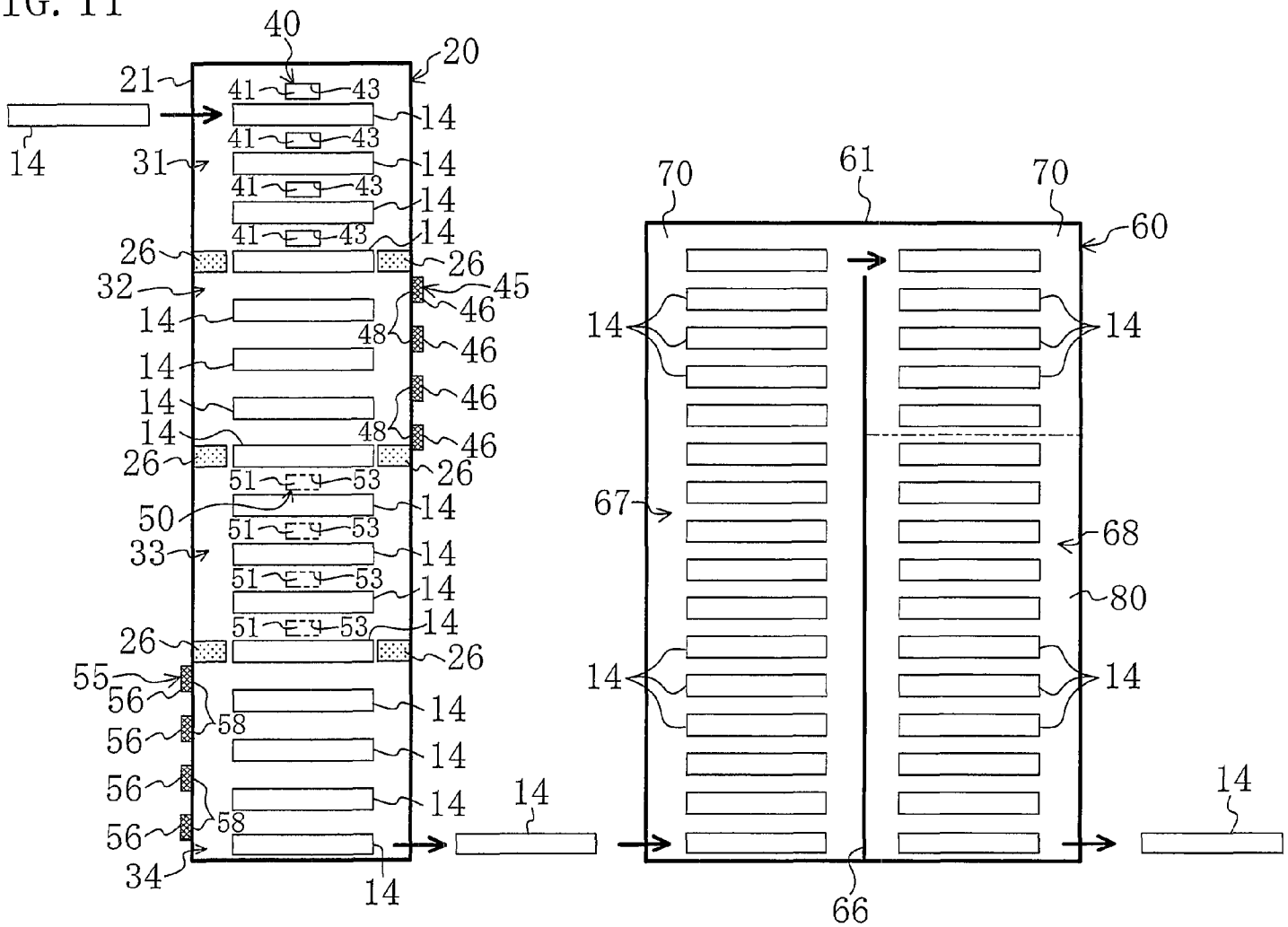
FIG. 11 is a front view illustrating a production apparatus of a fourth embodiment, partially omitted.
Figure 12:
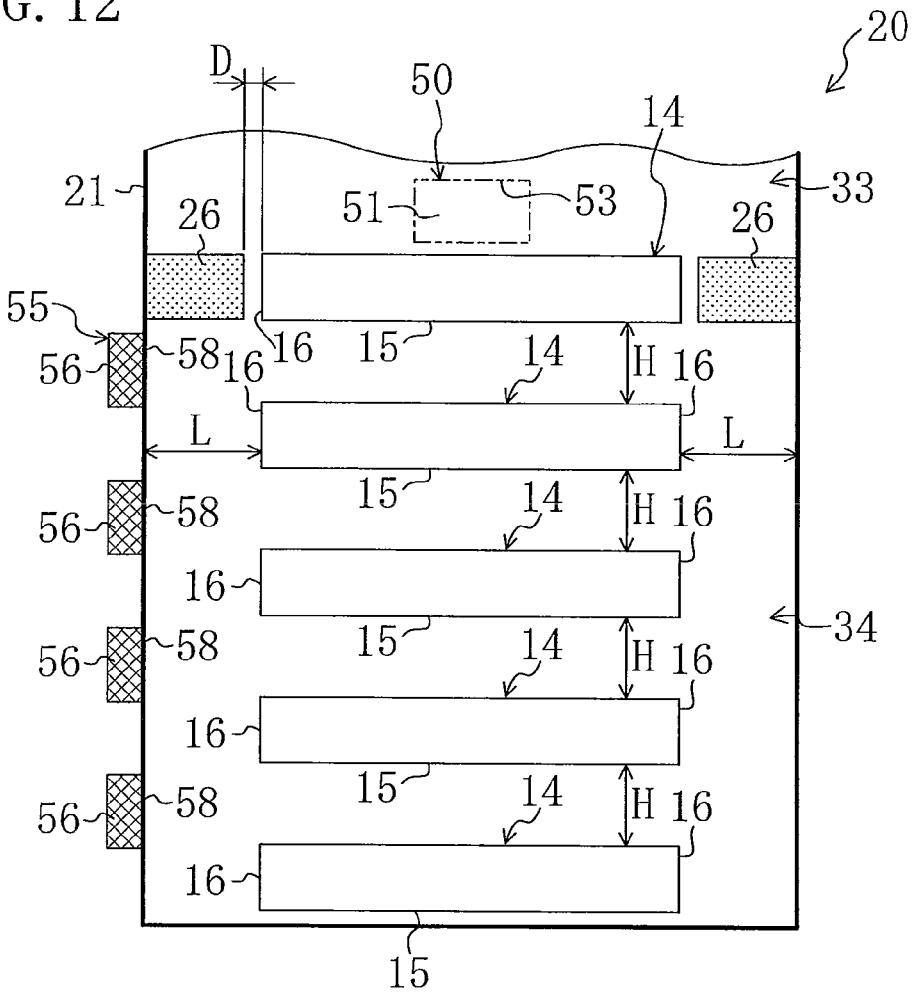
FIG. 12 is a front view illustrating a major part of a former unit of the fourth embodiment, partially omitted.

As shown in FIG. 11, the production apparatus (1) of the present embodiment includes one former unit (20) and one latter unit (60). Hereinafter, difference of the production apparatus (1) of the present embodiment from that of the third embodiment will be described. In the following description, "right," "left," "front," "rear," "frontward," and "rearward" are directions relative to the production apparatus (1) viewed from the front.

In the present embodiment, a main casing (21) of the former unit (20) is in the shape of a hollow prism, and is placed with the longitudinal direction thereof approximately matching with the vertical direction. The main casing (21) is as large as it can contain sixteen transfer trays (14) vertically aligned at regular intervals H. With the sixteen transfer trays (14) contained in the main casing (21), a distance between upper end surfaces of side plates (16) of the uppermost transfer tray (14) and a ceiling surface of the main casing (21) is set to the same value as the interval H between the vertically aligned transfer trays (14). A distance between the side plates (16) of the transfer tray (14) and an inner wall surface of the main casing (21) facing thereto is set to a length L in every circumferential direction of the transfer tray (14). The main casing (21) and the transfer trays (14) of the present embodiment are both made of stainless steel.

Although not shown, the former unit (20) includes a tray drive for transferring the transfer trays (14) in an irradiation zone (30). The tray drive is configured in the same manner as the tray drive described in the third embodiment. Specifically, the tray drive moves arm members carrying the transfer trays (14) thereon, thereby transferring the transfer trays (14) from the top to the bottom in space inside the main casing (21).

Three shielding frames (26) are provided in the main casing (21) of the former unit (20). Each of the shielding frames (26) is formed along an inner wall surface of the main casing (21) to surround the transfer tray (14). In the main casing (21), one shielding frame (26) is arranged to surround the fourth uppermost transfer tray (14), one shielding frame (26) is arranged to surround the eighth uppermost transfer tray (14), and one shielding frame (26) is arranged to surround the twelfth uppermost transfer tray (14). Each of the shielding frames (26) has a rectangular cross section, and an inner circumferential surface thereof is opposed to the side plates (16) of the corresponding transfer tray (14). The height of each of the shielding frames (26) is equal to or slightly larger than the height of the transfer tray (14). The shielding frames (26) are made of metal.

In the space inside the main casing (21), a region extending from the top of the main casing (21) to the uppermost shielding frame (26) serves as a first irradiation zone (31), a region extending from the uppermost shielding frame (26) to the second uppermost shielding frame (26) serves as a second irradiation zone (32), a region extending from the second uppermost shielding frame (26) to the third uppermost shielding frame (26) serves as a third irradiation zone (33), and a region extending from the third uppermost shielding frame (26) to the bottom of the main casing (21) serves as a fourth irradiation zone (34). Each of the irradiation zones (31-34) contains four transfer trays (14).

The former unit (20) is provided with four microwave irradiators (40, 45, 50, 55). Each of the microwave irradiators (40, 45, 50, 55) includes four microwave oscillators (41, 46, 51, 56). The microwave oscillators (41, 46, 51, 56) of the present embodiment are also configured to generate a microwave having a frequency of 2.45 GHz at an output of about 1.0 kW.

The microwave oscillators (41) of the first microwave irradiator (40) are arranged on a rearward side surface (i.e., a rear surface) of the main casing (21). Four irradiation ports (43) are opened in the rear surface of the main casing (21) to face the first irradiation zone (31). The irradiation ports (43) are aligned in the vertical direction, and are positioned immediately above the transfer trays (14) contained in the first irradiation zone (31), respectively. The microwave oscillators (41) are attached to the irradiation ports (43), respectively.

The microwave oscillators (46) of the second microwave irradiator (45) are arranged on a right side surface of the main casing (21). Four irradiation ports (48) are opened in the right side surface of the main casing (21) to face the second irradiation zone (32). The irradiation ports (48) are aligned in the vertical direction, and are positioned immediately above the transfer trays (14) contained in the second irradiation zone (32), respectively. The microwave oscillators (46) are attached to the irradiation ports (48), respectively.

The microwave oscillators (51) of the third microwave irradiator (50) are arranged on a front surface of the main casing (21). Four irradiation ports (53) are opened in the front surface of the main casing (21) to face the third irradiation zone (33). The irradiation ports (53) are aligned in the vertical direction, and are positioned immediately above the transfer trays (14) contained in the third irradiation zone (33), respectively. The microwave oscillators (51) are attached to the irradiation ports (53), respectively.

The microwave oscillators (56) of the fourth microwave irradiator (55) are arranged on a left side surface of the main casing (21). Four irradiation ports (58) are opened in the left side surface of the main casing (21) to face the fourth irradiation zone (34). The irradiation ports (58) are aligned in the vertical direction, and are positioned immediately above the transfer trays (14) contained in the fourth irradiation zone (34), respectively. The microwave oscillators (56) are attached to the irradiation ports (58), respectively.

Although not shown, air intake ducts and air exhaust dusts are connected also to the main casing (21) of the former unit (20) of the present embodiment. The air intake ducts are connected to the rearward side surface (i.e., the rear surface) of the main casing (21). A predetermined number of air intake ducts are connected to the rear surface of the main casing (21) to face each of the irradiation zones (31-34). The air exhaust ducts are connected to the front surface of the main casing (21). A predetermined number of air exhaust ducts are connected to the front surface of the main casing (21) to face each of the irradiation zones (31-34).

Outside air heated to about 60-100° C. is blown into the irradiation zones (31-34) in the main casing (21) through the air intake ducts. Air sucked into the air exhaust ducts from the irradiation zones (31-34) is all discharged outside the apparatus. The air sucked into the air exhaust ducts is released outside the apparatus after a suitable treatment, such as removal of harmful substances, etc., is done.

In the former unit (20) of the present embodiment, a distance H between the vertically aligned transfer trays (14), and a distance H between the uppermost transfer tray (14) and a ceiling surface of the main casing (21) are both set to a value of $\lambda/2$ or larger. A distance L between an inner wall surface of the main casing (21) of the former unit (20) and side plates (16) of the transfer trays (14) is set to a value of $\lambda$ or larger. Further, in the former unit (20), a distance D between an inner circumferential surface of the shielding frame (26) and the side plates (16) of the transfer tray (14) adjacent to the shielding frame (26) is set to a value that does not allow the microwave to pass through a gap between them.

—Working Mechanism—

A working mechanism of the production apparatus (1) of the present embodiment will be described. Description of a working mechanism of the latter unit (60) is omitted because it is the same as that described in the third embodiment.

In each of the former units (20), the transfer trays (14) each carrying the wet PTFE powder enters the upper end portion of the first irradiation zone (31) one by one every 3 minutes and 45 seconds. The transfer trays (14) entered the main casing (21) of the former unit (20) move downward stage by stage every 3 minutes and 45 seconds. The transfer trays (14) move from the first irradiation zone (31) to the fourth irradiation zone (34) through the second irradiation zone (32) and the third irradiation zone (33). In the former unit (20), the transfer trays (14) exit from the lower end portion of the fourth irradiation zone (34) one by one every 3 minutes and 45 seconds.

To the transfer trays (14) in the main casing (21) of the former unit (20), the microwave irradiators (40, 45, 50, 55) apply the microwave. The moisture in the PTFE powder placed on each of the transfer trays (14) in each of the irradiation zones (31-34) is heated to evaporate as it absorbs the microwave. The moisture evaporated from the PTFE powder on each of the transfer trays (14) is discharged outside the apparatus together with the air in each of the irradiation zones (31-34) through the air exhaust ducts.

Focusing on one of the transfer trays (14), a working mechanism of the former unit (20) will be described below.

The transfer tray (14) carrying the wet PTFE powder is placed on the uppermost stage in the first irradiation zone (31), and is transferred downward stage by stage. The microwave generated by the first microwave irradiator (40) is applied from behind to each of the transfer trays (14) in the first irradiation zone (31). The transfer tray (14) arrived at the lower end portion of the first irradiation zone (31) enters the second irradiation zone (32).

The transfer tray (14) is transferred downward stage by stage in the second irradiation zone (32). The microwave generated by the second microwave irradiator (45) is applied from the right to each of the transfer trays (14) in the second microwave irradiator (45). The transfer tray (14) arrived at the lower end portion of the second irradiation zone (32) enters the third irradiation zone (33).

The transfer tray (14) is transferred downward stage by stage in the third irradiation zone (33). The microwave generated by the third microwave irradiator (50) is applied from the front to each of the transfer trays (14) in the third irradiation zone (33). The transfer tray (14) arrived at the lower end portion of the third irradiation zone (33) enters the fourth irradiation zone (34).

The transfer tray (14) is transferred downward stage by stage in the fourth irradiation zone (34). The microwave generated by the fourth microwave irradiator (55) is applied from the left to the transfer trays (14) in the fourth irradiation zone (34). The transfer tray (14) arrived at the lower end portion of the fourth irradiation zone (34) exists from the main casing (21). Then, the transfer tray exited from the former unit (20) enters the latter unit (60).

In this way, in the former unit (20), the microwave is applied to the transfer tray (14) from behind in the first irradiation zone (31), from the right in the second irradiation zone (32), from the front in the third irradiation zone (33), and from the left in the fourth irradiation zone (34). That is, in the former unit (20), the direction of microwave application varies by 90° as the transfer trays (14) sequentially move from the first irradiation zone (31) to the fourth irradiation zone (34).

First Modified Example of Fourth Embodiment

Figure 13:
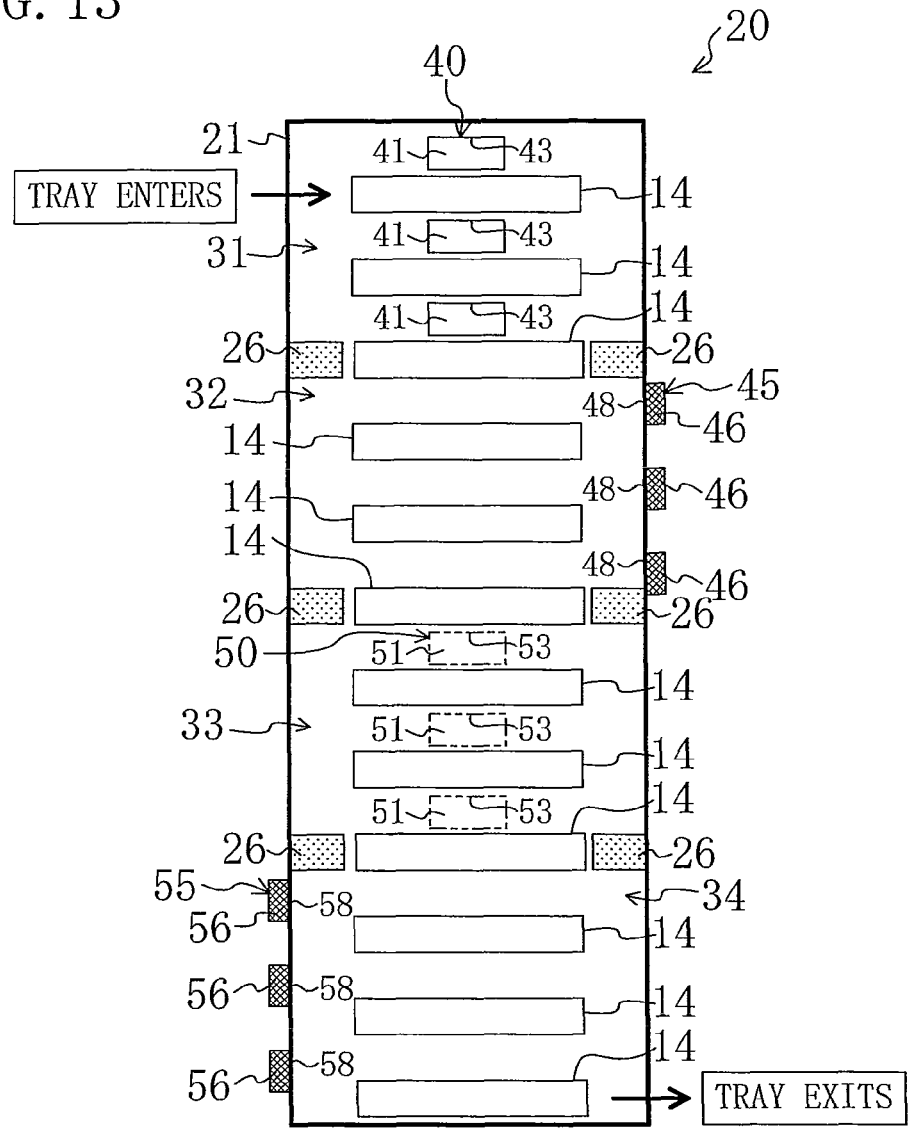
FIG. 13 is a front view illustrating a first modified example of the former unit of the fourth embodiment, partially omitted.

As shown in FIG. 13, the former unit (20) of the present embodiment may be configured to contain three transfer trays (14) in each of the irradiation zones (31-34).

In the former unit (20) of this modified example, twelve transfer trays (14) are contained in the main casing (21). The four microwave irradiators (40, 45, 50, 55) attached to the former unit (20) includes three microwave oscillators (41, 46, 51, 56), respectively.

Second Modified Example of Fourth Embodiment

Figure 14:
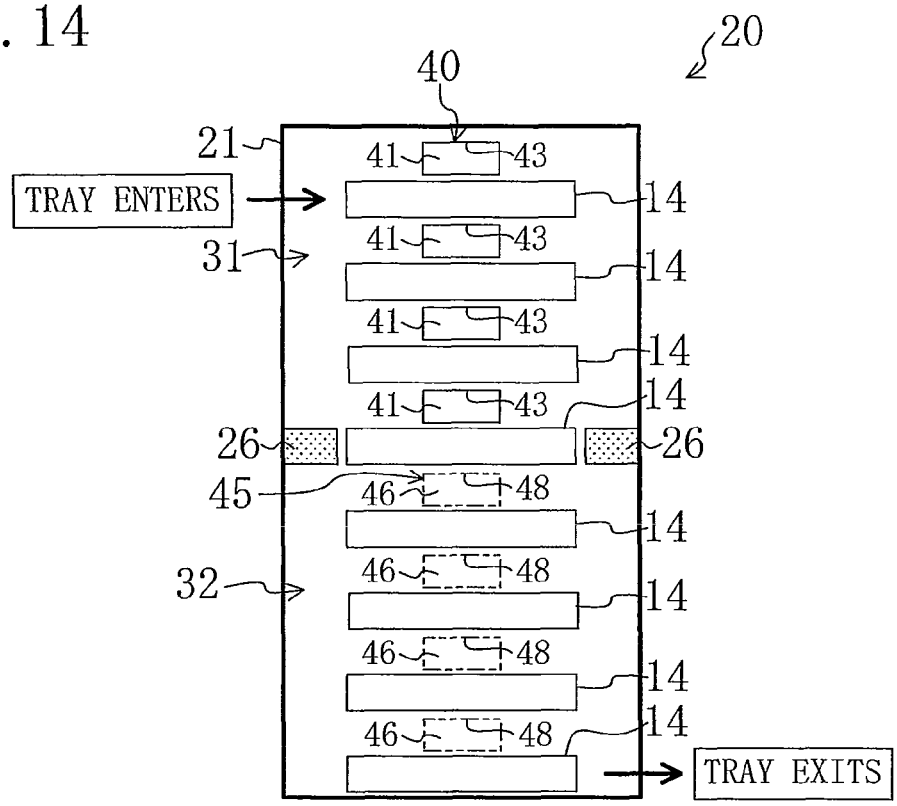
FIG. 14 is a front view illustrating a second modified example of the former unit of the fourth embodiment, partially omitted.

As shown in FIG. 14, the former unit (20) of this modified example may be configured to form two irradiation zones (31, 32) in the main casing (21).

In this modified example, only one shielding frame (26) is provided in a vertical center of the main casing (21). In space inside the main casing (21), a region above the shielding frame (26) serves as the first irradiation zone (31), and a region below the shielding frame (26) serves as the second irradiation zone (32). Each of the irradiation zones (31, 32) contains four transfer trays (14).

The former unit (20) of this modified example includes two microwave irradiators (40, 45). Each of the microwave irradiators (40, 45) includes four microwave oscillators (41, 46).

The microwave oscillators (41) of the first microwave irradiator (40) are arranged on a rearward side surface (i.e., a rear surface) of the main casing (21). Four irradiation ports (43) are opened in the rear surface of the main casing (21) to face the first irradiation zone (31). The irradiation ports (43) are aligned in the vertical direction, and are positioned immediately above the transfer trays (14) contained in the first irradiation zone (31), respectively. The microwave oscillators (41) are attached to the irradiation ports (43), respectively.

The microwave oscillators (46) of the second microwave irradiator (45) are arranged on a front surface of the main casing (21). Four irradiation ports (48) are opened in the front surface of the main casing (21) to face the second irradiation zone (32). The irradiation ports (48) are aligned in the vertical direction, and are positioned immediately above the transfer trays (14) contained in the second irradiation zone (32), respectively. The microwave oscillators (46) are attached to the irradiation ports (48), respectively.

The transfer trays (14) entered the main casing (21) of the former unit (20) move downward stage by stage from the uppermost stage in the first irradiation zone (31) to the lowermost stage in the second irradiation zone (32). The microwave generated by the first microwave irradiator (40) is applied from behind to the transfer trays (14) in the first irradiation zone (31). The microwave generated by the second microwave irradiator (45) is applied from the front to the transfer trays (14) in the second irradiation zone (32).

In this way, in the former unit (20), the microwave is applied to the transfer trays (14) from behind in the first irradiation zone (31), and from the front in the second irradiation zone (32). That is, the direction of microwave application to the transfer trays (14) varies by 180° as the transfer trays (14) sequentially move from the first irradiation zone (31) to the second irradiation zone (32).

Other Embodiments

In the former units (20) of the above-described embodiments, the wet PTFE powder is used as an object to be treated. However, the object of the former unit (20) is not limited to the PTFE powder. Specifically, in the former unit (20) of the present embodiment, granules made of a resin other than PTFE, for example, may be dried as the object. The granules mentioned herein indicate fine particles of about several μm particle diameter, as well as pellets of several mm particle diameter.

Examples of the resin forming the granules include general-purpose resins, so-called engineering plastics, etc. Specific examples of the resins for forming the granules include polyethylene, polyvinyl chloride, polypropylene, polystyrene, polyvinyl acetate, ABS resin (acrylonitrile-butadiene-styrene resin), AS resin (acrylonitrile-styrene resin), metacrylate resin, polyacetal, polyamide, polyimide, polyamide-imide, polycarbonate, polyphenylene ether, polybutylene terephthalate, polyarylate, polysulfone, polyether sulfone, polyether imide, polyphenylene sulfide, polyether ether ketone, fluorine-containing resin, etc.

Examples of the fluorine-containing resin include polytetrafluoroethylene (PTFE), tetrafluoroethylene/hexafluoropropylene copolymer (FEP), tetrafluoroethylene/perfluoroalkyl vinyl ether copolymer (PFA), polychlorotrifluoroethylene (PCTFE), polyvinylidene fluoride (PVDF), ethylene/tetrafluoroethylene copolymer (ETFE), ethylene/chlorotrifluoroethylene copolymer (ECTFE), etc.

The metallic members, such as the transfer trays (14) and the main casing (21) of the former unit (20) of the above-described embodiment, are made of stainless steel. However, they may be made of metal other than stainless steel (e.g., titanium, etc.).

The above-described embodiments are merely preferred embodiments in nature, and are not intended to limit the scope, applications and use of the invention.

INDUSTRIAL APPLICABILITY

As described above, the present invention is useful for drying apparatuses for drying an object by microwave application.

The invention claimed is:

1. A drying apparatus for drying a moisture-containing object by applying a microwave to the object, the drying apparatus comprising:

a metallic transfer tray for carrying the moisture-containing object; and a main body for containing multiple ones of the transfer tray vertically aligned at predetermined intervals, and laterally applying the microwave to the contained transfer trays, wherein a distance between the vertically adjacent transfer trays in the main body is set to λ/2 or larger, where λ is a wavelength of the microwave applied to the transfer trays;

the main body includes a plurality of microwave irradiators which apply the microwave to the transfer trays in different directions, each of the microwave irradiators includes a microwave oscillator, and a plurality of waveguides connected to the microwave oscillator and the main body and guiding the microwave generated by the microwave oscillator, terminal ends of the waveguides are irradiation ports, each of which is opened on a side surface of the main body and positioned between the transfer trays adjacent to each other in the vertical direction, and the microwave irradiators irradiate the microwave from the irradiation ports which are the terminal ends of the waveguides.

2. The drying apparatus of claim 1, wherein the main body includes a metallic casing member for forming space for containing the vertically aligned transfer trays, and a distance between a side portion of each of the transfer trays and a portion of the casing member facing the side portion of each of the transfer trays is set to λ or larger.

3. The drying apparatus of claim 1, wherein the main body includes a transfer mechanism for transferring the vertically aligned transfer trays, and a direction of microwave application to the transfer trays varies as the transfer trays move.

4. The drying apparatus of claim 1, wherein the main body includes a transfer mechanism for transferring the vertically aligned transfer trays, and the plurality of microwave irradiators are arranged in the direction of movement of the transfer trays, with their directions of microwave application to the transfer trays different from each other.

5. The drying apparatus of claim 4, wherein each of the transfer trays is rectangular-shaped, and the microwave irradiators are arranged in one-to-one correspondence with sides of the transfer trays.

6. The drying apparatus of claim 3, 4, or 5, wherein a tray unit including the multiple transfer trays vertically aligned at intervals of λ/2 or larger is formed in the main body, and the transfer mechanism is configured to horizontally move the tray unit.

7. The drying apparatus of claim 1, wherein the object to be dried is resin powder.

8. The drying apparatus of claim 1, wherein the main body includes a metallic casing member, and the plurality of irradiation ports are opened on at least one of exterior-facing surfaces of the metallic casing member.

9. The drying apparatus of claim 8, wherein the exterior-facing surfaces of the metallic casing member include a left side surface and a right side surface, and the plurality of irradiation ports are opened on both of the left side surface and the right side surface.

10. The drying apparatus of claim 1, wherein space inside the main body is divided into a plurality of rooms by one or more partition doors, and each of the plurality of rooms contains multiple ones of the transfer tray vertically aligned at predetermined intervals.

* * * * *